US008438669B2

(12) United States Patent
Turner

(10) Patent No.: US 8,438,669 B2
(45) **Date of Patent: *May 14, 2013**

(54) APPAREL INCORPORATING A PROTECTIVE ELEMENT

(75) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 83 days.

This patent is subject to a terminal disclaimer.

(21) Appl. No.: 13/111,461

(22) Filed: May 19, 2011

(65) Prior Publication Data

US 2011/0277226 A1 Nov. 17, 2011

Related U.S. Application Data

(63) Continuation-in-part of application No. 12/490,001, filed on Jun. 23, 2009, now Pat. No. 8,095,996.

(51) Int. Cl.
*A41D 13/05* (2006.01)
*A41D 13/015* (2006.01)
*A41D 13/00* (2006.01)

(52) U.S. Cl.
USPC ..... 2/456; 2/455; 2/22; 2/24; 2/267

(58) Field of Classification Search ..... 2/2, 16, 2/22, 24, 267, 268, 243 R, 243 A, DIG. 1, 2/44, 45; 128/89 R, 156, 157
See application file for complete search history.

(56) References Cited

U.S. PATENT DOCUMENTS

| | | | | |
|---|---|---|---|---|
| 3,119,904 A | | 1/1964 | Anson | |
| 3,772,704 A | * | 11/1973 | Carbonneau | 2/22 |
| 3,991,420 A | * | 11/1976 | Savarino | 2/462 |
| 4,441,211 A | | 4/1984 | Donzis | |
| 4,580,297 A | * | 4/1986 | Maejima | 2/22 |
| 4,599,747 A | * | 7/1986 | Robinson | 2/461 |
| 4,688,269 A | * | 8/1987 | Maeshima | 2/456 |
| 4,982,447 A | | 1/1991 | Henson | |
| 4,985,931 A | | 1/1991 | Wingo | |
| 5,014,354 A | * | 5/1991 | Dumont | 2/23 |
| 5,029,341 A | | 7/1991 | Wingo, Jr. | |
| 5,052,052 A | * | 10/1991 | Gilford et al. | 2/467 |
| 5,067,175 A | * | 11/1991 | Gold | 2/16 |
| 5,168,576 A | * | 12/1992 | Krent et al. | 2/456 |
| 5,220,691 A | * | 6/1993 | Wiegers | 2/24 |
| 5,337,418 A | * | 8/1994 | Kato et al. | 2/456 |
| 5,373,584 A | * | 12/1994 | Parcells, III | 2/465 |
| 5,423,087 A | * | 6/1995 | Krent et al. | 2/463 |

(Continued)

FOREIGN PATENT DOCUMENTS

EP 0254751 2/1988

OTHER PUBLICATIONS

International Search Report and Written Opinion in PCT Application No. PCT/US2012/038174, mailed on Sep. 26, 2012.

*Primary Examiner* — Bobby Muromoto, Jr.

(74) *Attorney, Agent, or Firm* — Plumsea Law Group, LLC

(57) ABSTRACT

Protective components may include a plate element and a cushioning element that are secured together with a hook-and-loop fastening system. The cushioning element may include a pair of material layers and a plurality of pads located between the material layers. The plate element may include a polymer material and the pads may include a polymer foam material, with the polymer material of the plate element having greater rigidity and density than the polymer foam material of the pads.

29 Claims, 40 Drawing Sheets

U.S. PATENT DOCUMENTS 5,530,966 A * 7/1996 West ..... 2/462
5,621,914 A * 4/1997 Ramone et al. ..... 2/463
5,689,836 A 11/1997 Fee et al.
5,729,832 A * 3/1998 Grilliot et al. ..... 2/23
5,940,888 A 8/1999 Sher
5,948,621 A * 9/1999 Turner et al. ..... 435/6.11
6,205,583 B1 * 3/2001 Beland ..... 2/16
6,295,654 B1 * 10/2001 Farrell ..... 2/456
6,401,366 B2 * 6/2002 Foxen et al. ..... 36/91
6,510,560 B1 * 1/2003 Ugolnik ..... 2/455
6,519,782 B2 * 2/2003 Collins et al. ..... 2/463
6,654,960 B2 12/2003 Cho
6,743,325 B1 6/2004 Taylor
6,817,039 B1 * 11/2004 Grilliot et al. ..... 2/413
7,114,189 B1 10/2006 Kleinert
7,188,370 B2 * 3/2007 Bevier ..... 2/22
7,316,083 B2 * 1/2008 Labonte ..... 36/115
7,350,240 B2 * 4/2008 LaGrone ..... 2/51
7,506,384 B2 3/2009 Ide et al.
7,512,996 B2 * 4/2009 Yoo et al. ..... 2/455
7,707,658 B2 * 5/2010 Culhane ..... 2/227
7,743,429 B2 * 6/2010 Bevier ..... 2/22
7,832,017 B2 * 11/2010 Nascimento et al. ..... 2/22
8,095,996 B2 * 1/2012 Turner ..... 2/456
2004/0229763 A1 * 11/2004 Hutton et al. ..... 510/220
2005/0167029 A1 * 8/2005 Rapaport et al. ..... 156/145
2005/0246812 A1 * 11/2005 Bevier ..... 2/22
2006/0260026 A1 * 11/2006 Doria et al. ..... 2/414
2007/0000005 A1 1/2007 Wang
2007/0124843 A1 * 6/2007 Bevier ..... 2/22
2008/0178360 A1 * 7/2008 Nascimento et al. ..... 2/22
2008/0178361 A1 * 7/2008 Yoo et al. ..... 2/24
2008/0264557 A1 10/2008 Kim
2008/0290556 A1 11/2008 Kim
2009/0070911 A1 3/2009 Chang
2009/0152774 A1 * 6/2009 Hensley et al. ..... 264/524
2009/0288312 A1 * 11/2009 Dua ..... 36/29
2009/0288313 A1 * 11/2009 Rapaport et al. ..... 36/29
2010/0024089 A1 * 2/2010 Turner ..... 2/23
2010/0024100 A1 * 2/2010 Sokolowski et al. ..... 2/455
2010/0024101 A1 * 2/2010 Berner et al. ..... 2/455
2010/0129573 A1 5/2010 Kim
2010/0193117 A1 8/2010 Kim
2010/0199406 A1 * 8/2010 Dua et al. ..... 2/115
2010/0205716 A1 8/2010 Kim
2010/0205722 A1 8/2010 Kim
2010/0206472 A1 8/2010 Kim
2010/0319097 A1 12/2010 Turner

* cited by examiner

APPAREL INCORPORATING A PROTECTIVE ELEMENT

CROSS-REFERENCE TO RELATED APPLICATION

This U.S. patent application is a continuation-in-part application and claims priority under 35 U.S.C. §120 to U.S. patent application Ser. No. 12/490,001, which was filed in the U.S. Patent and Trademark Office on 23 Jun. 2009 and entitled Apparel Incorporating A Protective Element, such prior U.S. patent application being entirely incorporated herein by reference.

BACKGROUND

Articles of athletic apparel commonly incorporate elements that cushion or protect an athlete from contact with other athletes, equipment, or the ground. Examples of these elements include (a) foam components that impart cushioning or otherwise attenuate impact forces and (b) rigid or semi-rigid plates that distribute impact forces. Many articles of athletic apparel combine foam components and plates to protect to the athlete by both attenuating and distributing impact forces. That is, the combination of a foam component and a plate may impart enhanced protection by both attenuating and distributing impact forces. As an example, shoulder pads and thigh pads worn under uniforms in American football include (a) foam components located adjacent to the athlete (i.e., in contact with the athlete or apparel worn adjacent to the skin of the athlete) and (b) plates secured to the foam components and located opposite the athlete. As another example, helmets utilized during American football, bicycling, hockey, skiing, snowboarding, and skateboarding also effectively combine polymer foam components with an external plate (i.e., the exterior of the helmet). Additionally, shin guards worn for soccer and leg guards worn for baseball include polymer foam components and an external plate.

SUMMARY

Various protective elements that may be utilized in articles of protective apparel are disclosed below. The apparel may include a plate element and a cushioning element. The plate element has a first part of a hook-and-loop fastening system, and the cushioning element incorporates a second part of the hook-and-loop fastening system. Moreover, the cushioning element includes (a) a first material layer and a second material layer and (b) a plurality of compressible pads located between the first material layer and the second material layer. The first part of the hook-and-loop fastening system is joinable to the second part of the hook-and-loop fastening system to secure the plate element to the cushioning element.

A method for wearing an article of apparel during an athletic training session and an athletic competition is also disclosed below. The method includes wearing a cushioning element without a plate element during the athletic training session. Additionally, the method includes wearing the cushioning element and the plate element during the athletic competition.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various apparel systems, articles of apparel, and protective components that may be incorporated into the apparel systems or articles of apparel.

Apparel System

Figure 1:
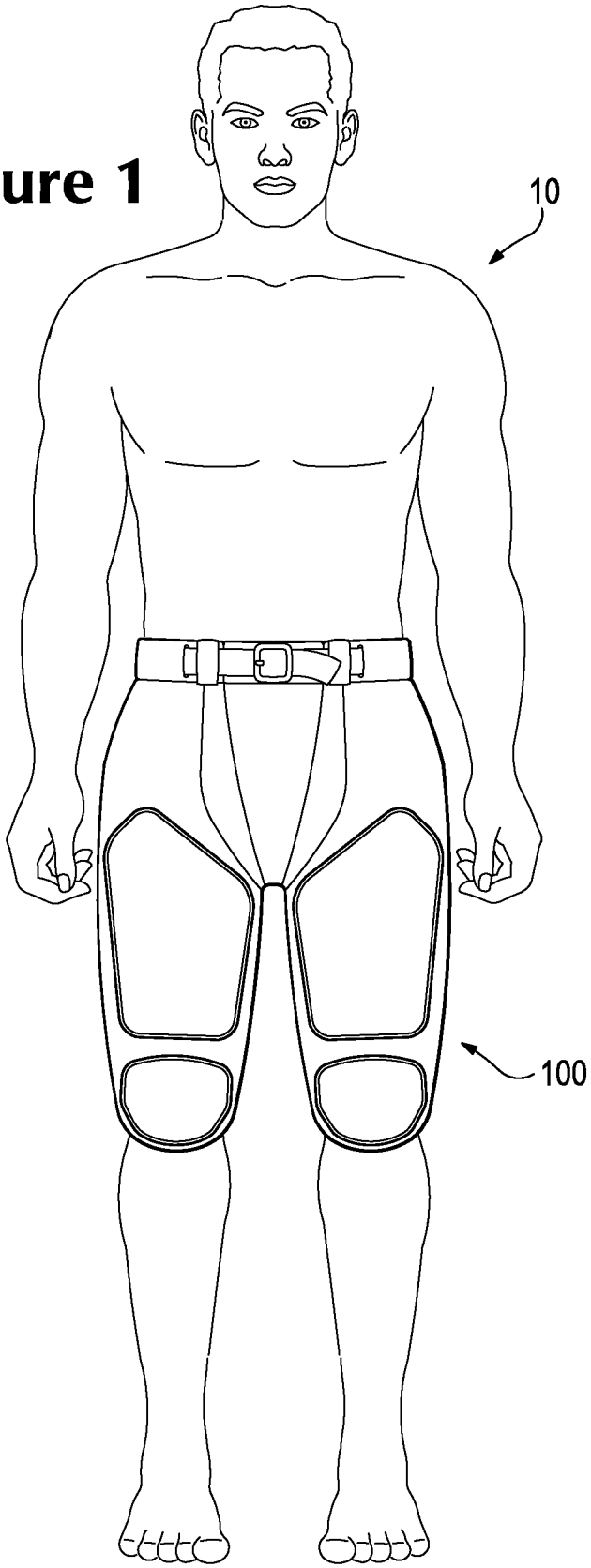
FIG. 1 is a front elevational view of an individual wearing an apparel system having an outer garment and an inner garment.
Figure 2:
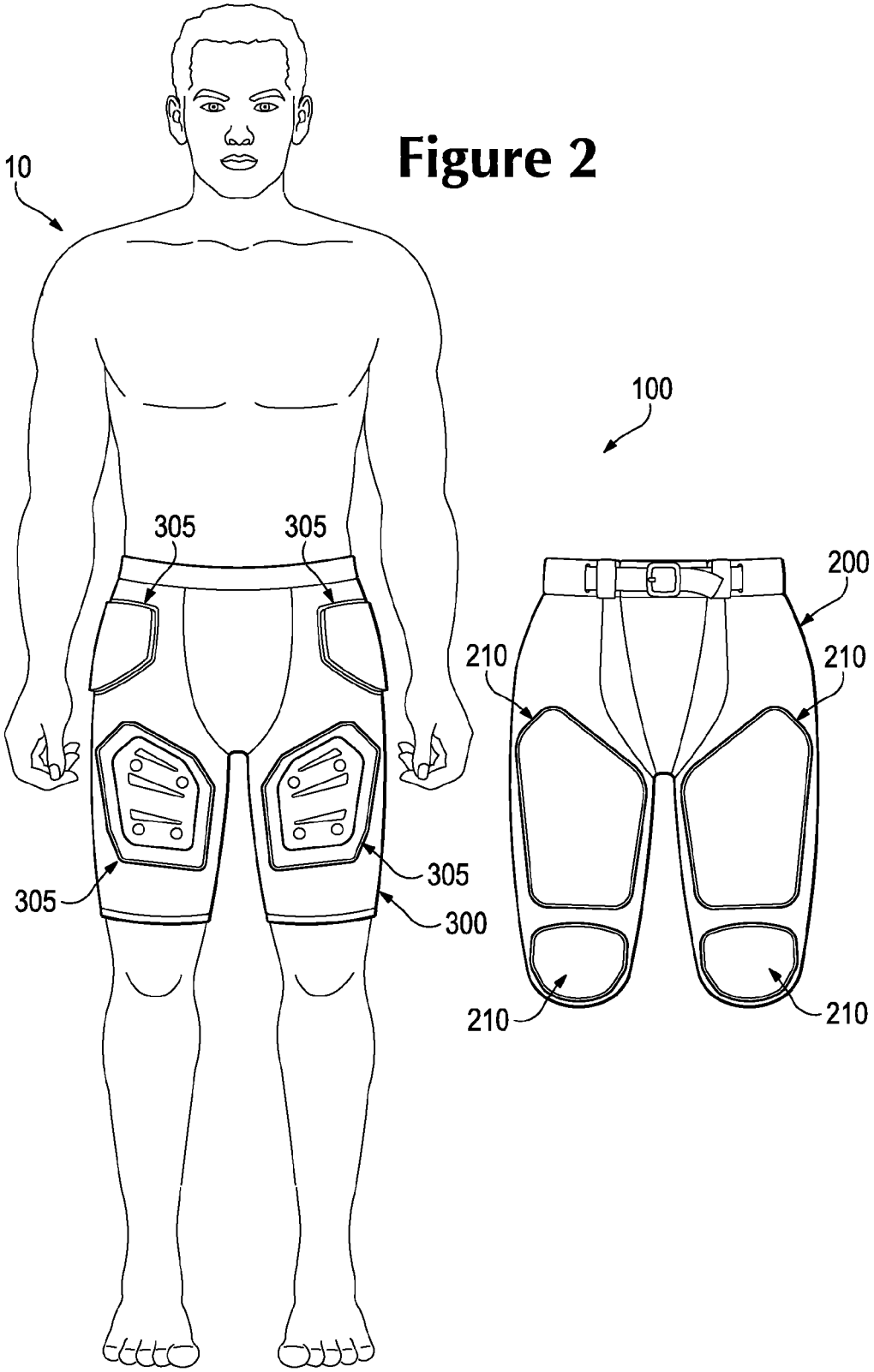
FIG. 2 is an exploded front elevational view of the individual wearing the apparel system.
Figure 3:
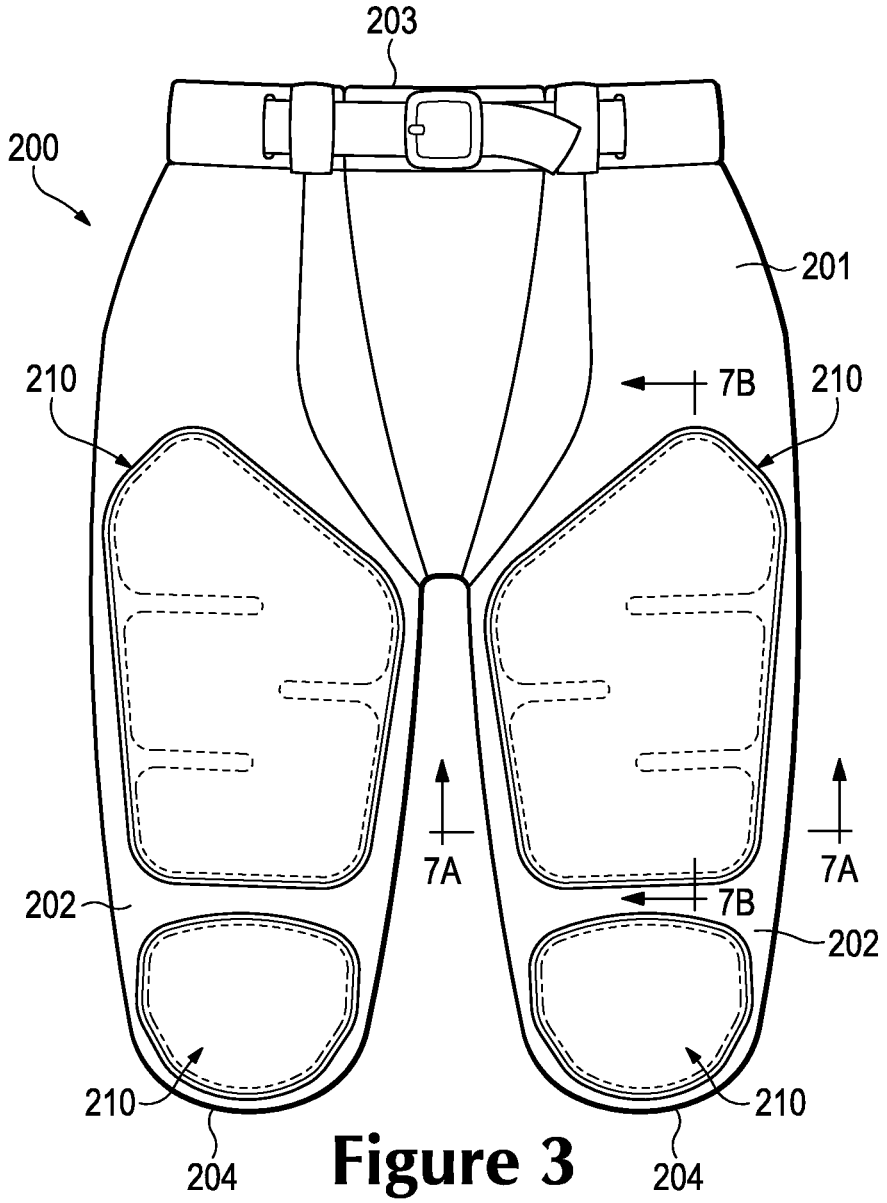
FIG. 3 is a front elevational view of the outer garment.
Figure 4:
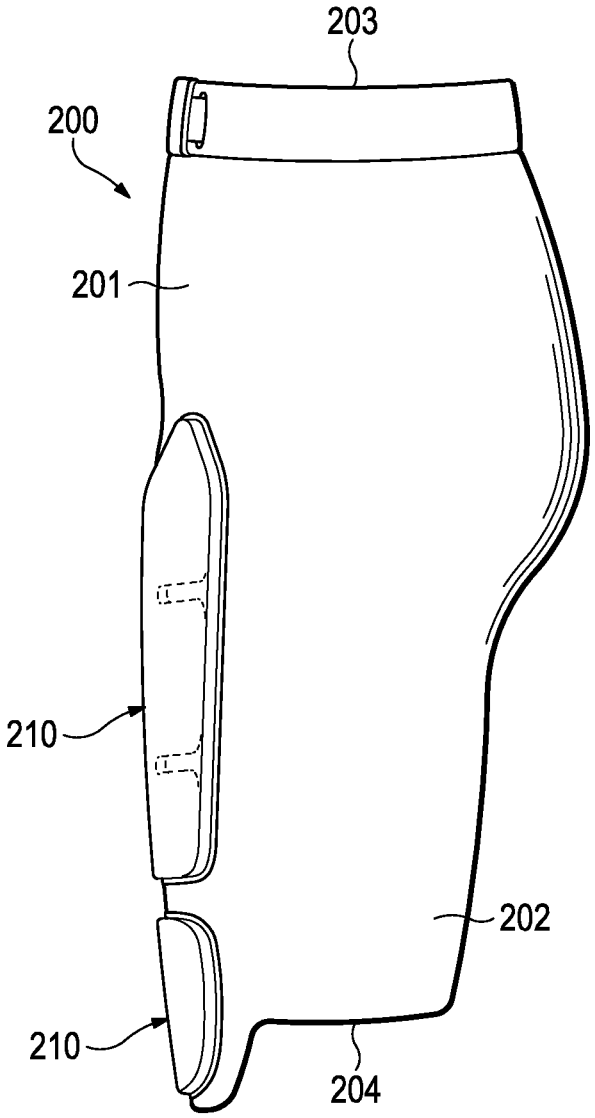
FIGS. 4 and 5 are side elevational views of the outer garment.
Figure 5:
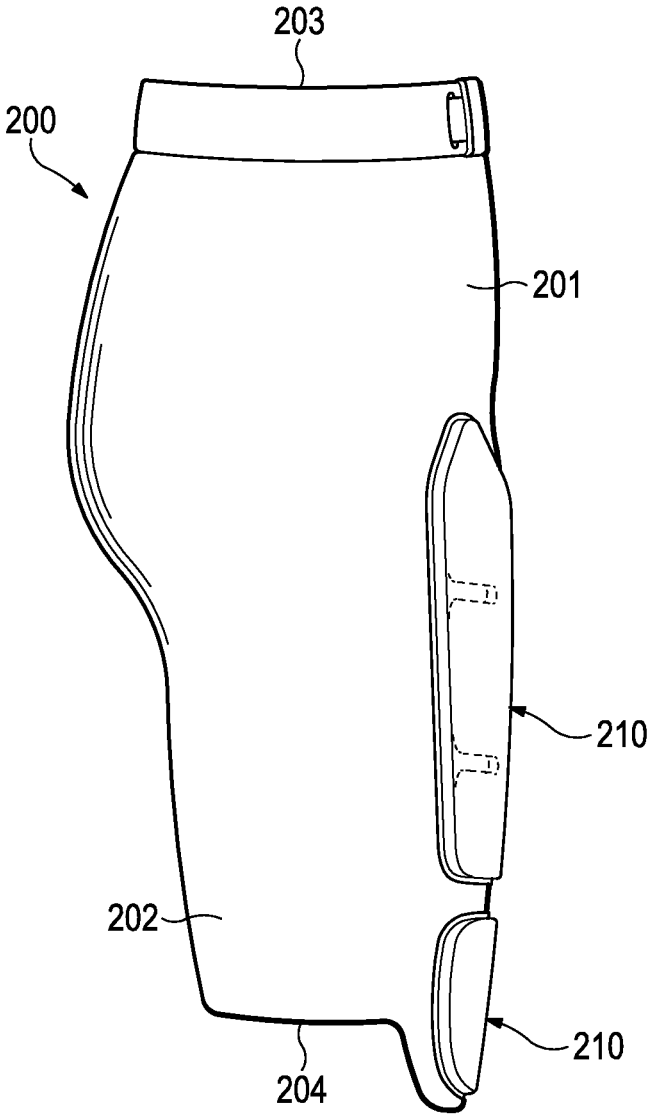
Figure 6:
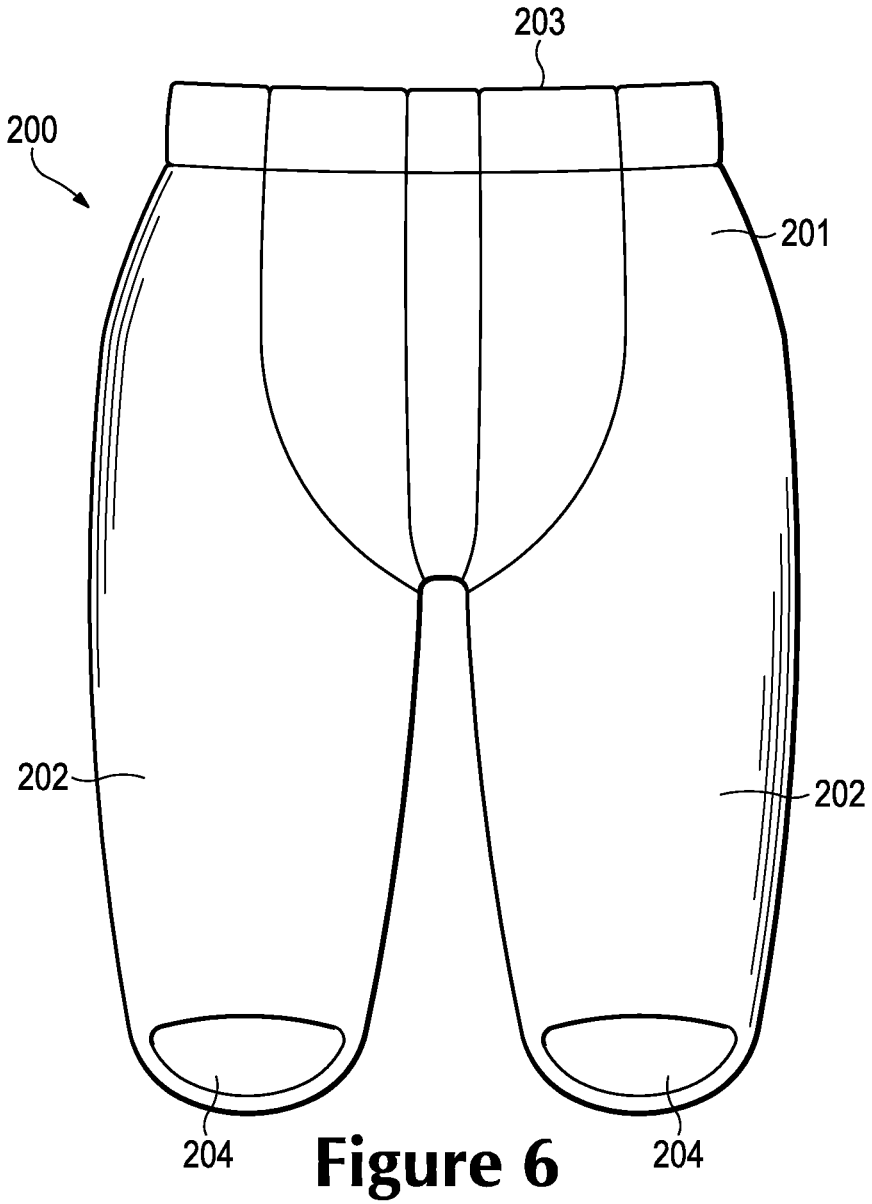
FIG. 6 is a rear elevational view of the outer garment.

With reference to FIGS. 1 and 2, an individual 10 is depicted as wearing an apparel system 100 that includes an outer garment 200 and an inner garment 300. Each of garments 200 and 300 exhibit the general configuration of a pants-type garment, which includes any of a plurality of articles of apparel that cover a portion of a pelvic area of individual 10 and may extend over legs of individual 10. Although garments 200 and 300 are each depicted as being pairs of shorts, various concepts disclosed below for garments 200 and 300 may also be applied to other pants-type garments, including pants, briefs, jeans, and underwear. The various concepts disclosed below for garments 200 and 300 may also be applied to shirt-type garments, which cover a portion of a torso area of individual 10 and may extend over arms of individual 10. Examples of shirt-type garments include long-sleeved shirts, short-sleeved shirts, tank tops, undershirts, jackets, and coats. In some configurations, articles of apparel incorporating concepts disclosed below for garments 200 and 300 may be combinations of shirt-type garments and pants-type garments, including bodysuits, leotards, unitards, and wetsuits. In addition, articles of apparel incorporating concepts disclosed below for garments 200 and 300 may have configurations that cover other areas of individual 10, such as hats, helmets, arm and leg wraps, gloves, socks, and footwear, for example.

Although apparel system 100 may be worn alone or exposed, apparel system 100 may also be worn in combination with other articles of apparel (e.g., under or over other articles of apparel). Apparel system 100 may also be worn in combination with other pieces of equipment (e.g., athletic or protective equipment). In general, outer garment 200 is worn over inner garment 300, thereby positioning outer garment 200 to be exterior of inner garment 300. Whereas inner garment 300 may be worn in contact with and to cover individual 10, outer garment 200 may be worn in contact with and to cover inner garment 300. That is, inner garment 300 is generally positioned between individual 10 and outer garment 200. Depending upon various factors (e.g., sport, activity, weather, preferences), the other articles of apparel or pieces of equipment may be worn (a) between inner garment 300 and individual 10, (b) between garments 200 and 300, or (c) exterior of outer garment 200. Accordingly, the configuration of apparel system 100, including each of the individual garments 200 and 300, and the manner in which apparel system 100 is worn by individual 10 may vary significantly.

Apparel system 100 incorporates various cover components 210 and protective components 305. More particularly, outer garment 200 includes cover components 210, and inner garment 300 includes protective components 305. Although cover components 210 and protective components 305 may each be utilized individually to impart padding, cushioning, or otherwise distribute or attenuate impact forces, thereby imparting protection to individual 10, components 210 and 305 may also operate cooperatively to impart protection to individual 10. For example, some cover components 210 may overlap, extend over, or otherwise coincide with the positions of some protective components 305. In areas where cover components 210 extend over protective components 305, both elements 210 and 305 may impart protection to individual 10. Additional details concerning garments 200 and 300, as well as components 210 and 305, will be discussed below.

Outer Garment Configuration

Outer garment 200, which incorporates cover components 210, is depicted individually in FIGS. 3-6 as including a pelvic region 201 and a pair of leg regions 202 that extend outward and downward from pelvic region 201. Pelvic region 201 corresponds with the pelvic area of individual 10 and extends over at least a portion of the pelvic area when worn. An upper portion of pelvic region 201 defines a waist opening 203 that extends around a waist of individual 10 when outer garment 200 is worn. Leg regions 202 correspond with a right leg and a left leg of individual 10 and cover at least a portion of the right leg and the left leg when worn. Lower portions of leg regions 202 each define a thigh opening 204 that extends around a thigh of individual 10 when outer garment 200 is worn.

Cover components 210 are incorporated into various areas of outer garment 200 to impart padding, cushioning, or otherwise attenuate impact forces, thereby imparting protection to individual 10. Two lower cover components 210 are located in a front area of leg regions 202 and adjacent to thigh openings 204, and two upper cover components 210 are also located in the front area of leg regions 202 and extend upward and into lower areas of pelvic region 201. As discussed above, cover components 210 may overlap, extend over, or otherwise coincide with the positions of some protective components 305 of inner garment 300. Whereas the upper cover components 210 coincide in location and extend over two of protective components 305, the lower cover components 210 are positioned separate from protective components 305. In this configuration, the upper cover components 210 and two of protective components 305 cooperatively impart protection to areas of individual 10, while the lower cover components 210 individually impart protection to areas of individual 10. In further configurations of apparel system 100 or outer garment 200, cover components 210 may be positioned in various areas of outer garment 200, including the sides or back of leg regions 202 or in pelvic region 201, to protect specific portions (e.g., muscles, bones, joints, impact areas) of individual 10. Additionally, the quantity, shapes, sizes, and other properties of cover components 210, as well as the materials utilized in cover components 210, may vary significantly to provide a particular level of protection to the specific portions of individual 10.

Figure 7A:
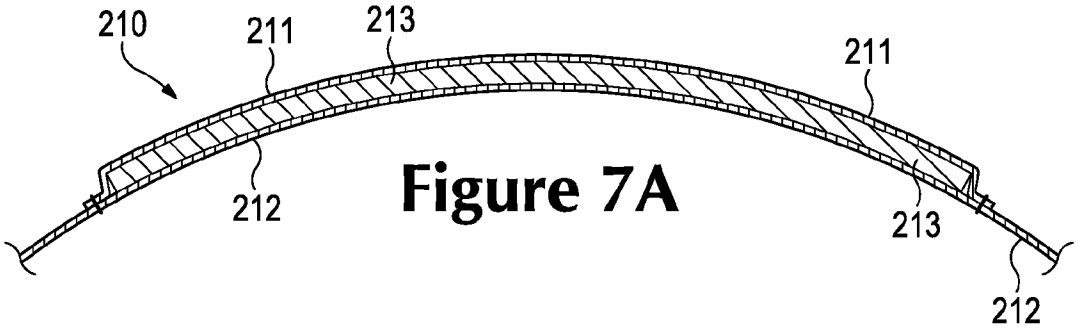
FIGS. 7A and 7B are cross-sectional views of the outer garment, as defined by section lines 7A and 7B in FIG. 3.
Figure 7B:
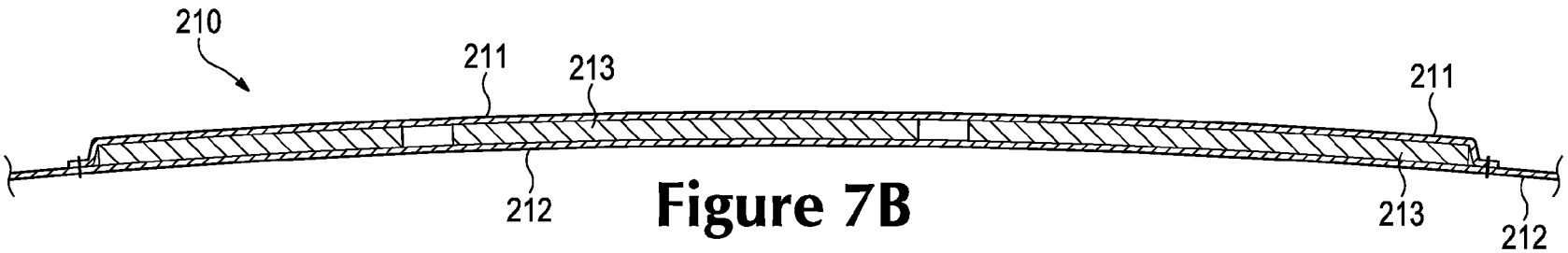
Figure 8:
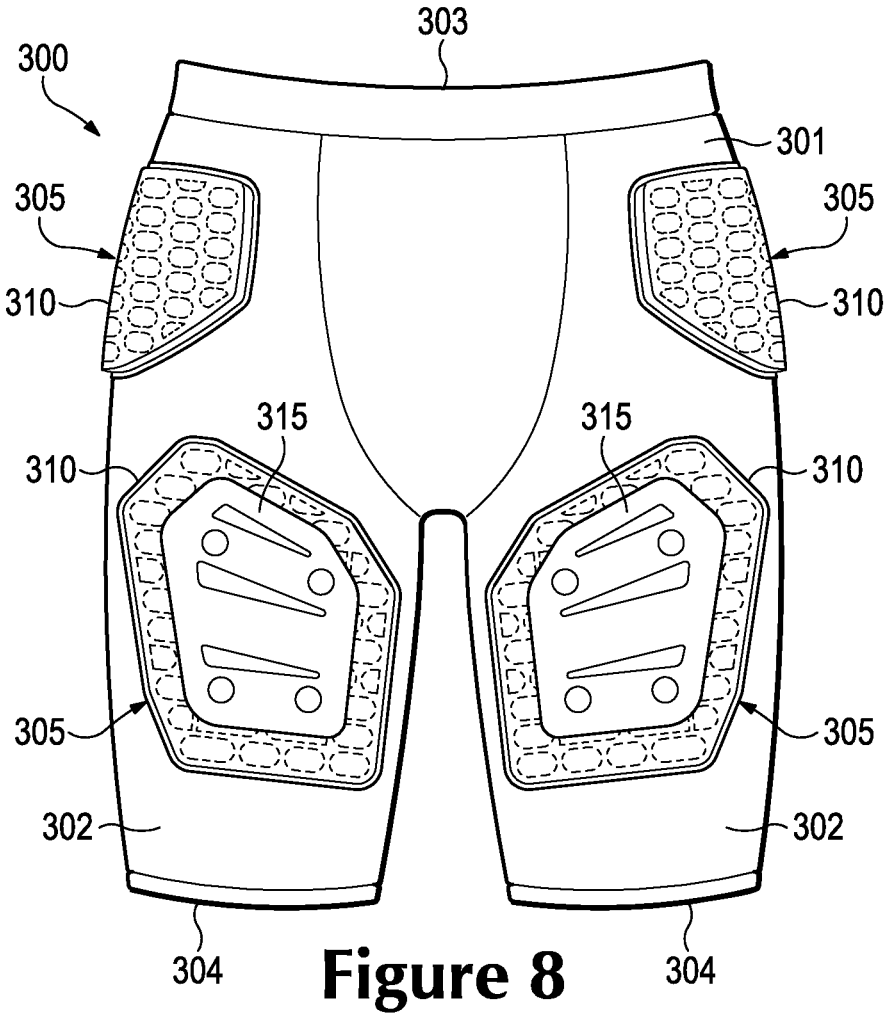
FIG. 8 is a front elevational view of the inner garment.
Figure 9:
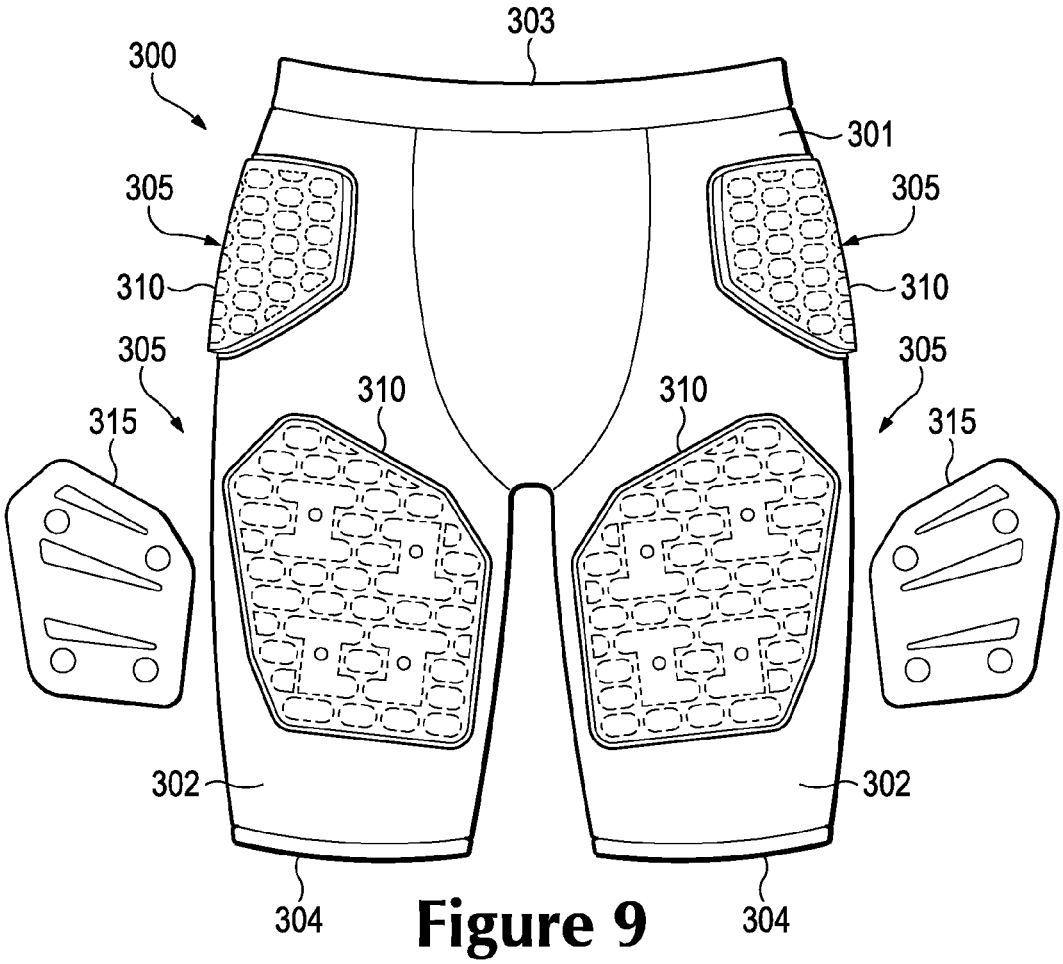
FIG. 9 is an exploded front elevational view of the inner garment.
Figure 10:
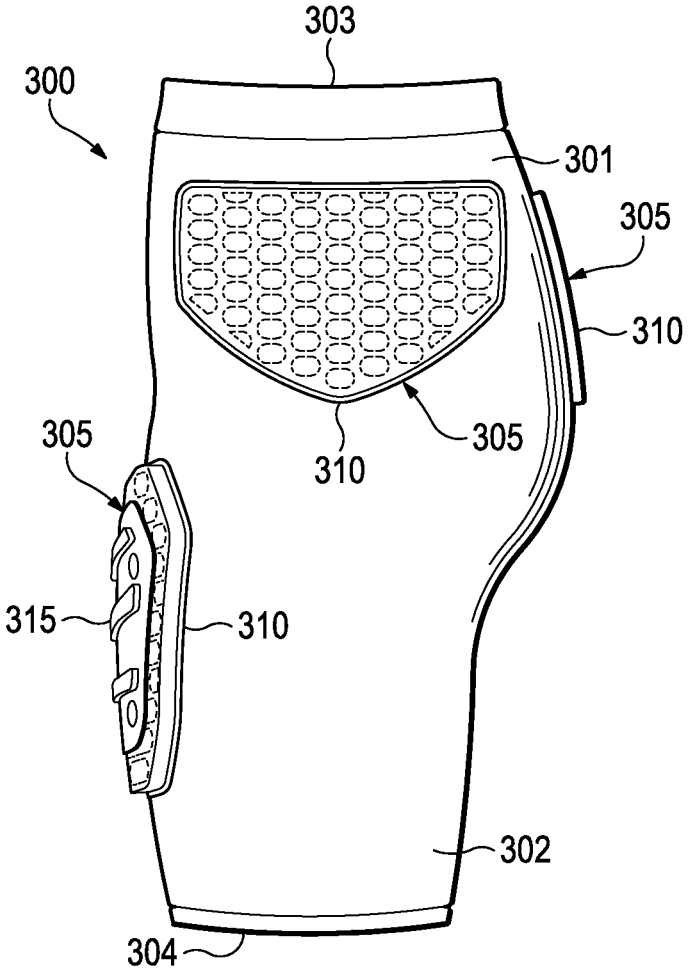
FIGS. 10 and 11 are side elevational views of the inner garment.
Figure 11:
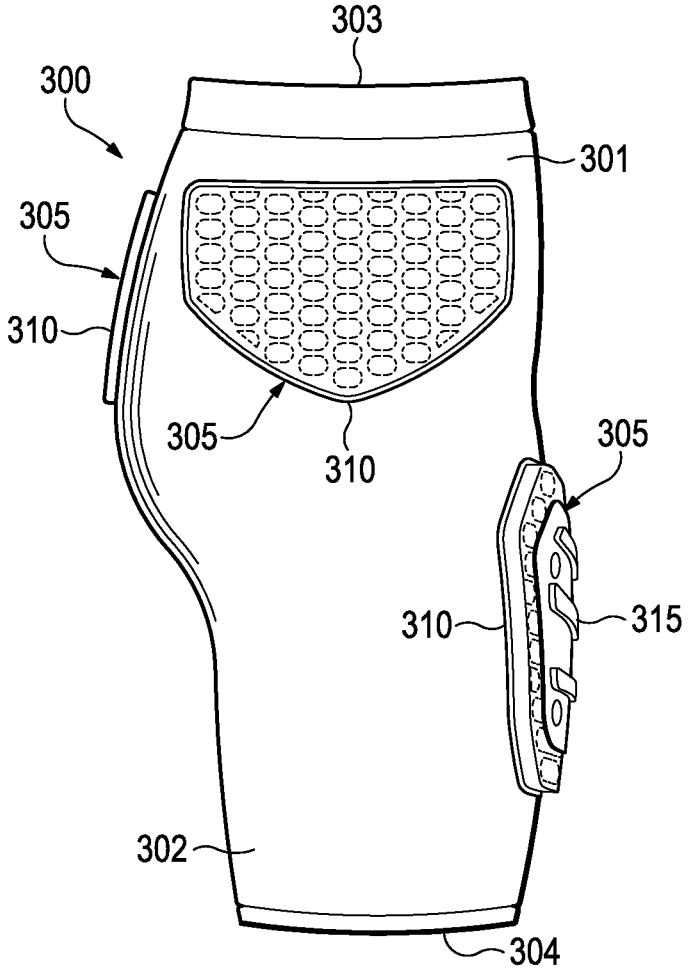
Figure 12:
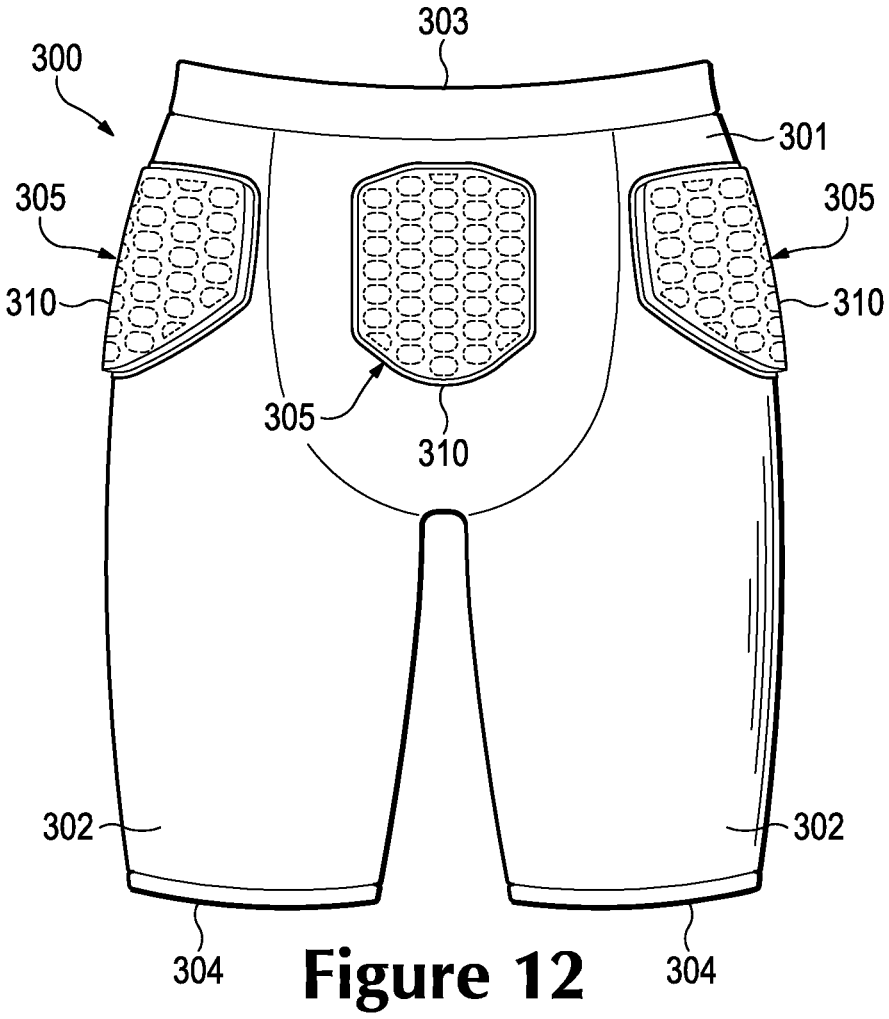
FIG. 12 is a rear elevational view of the inner garment.
Figure 13:
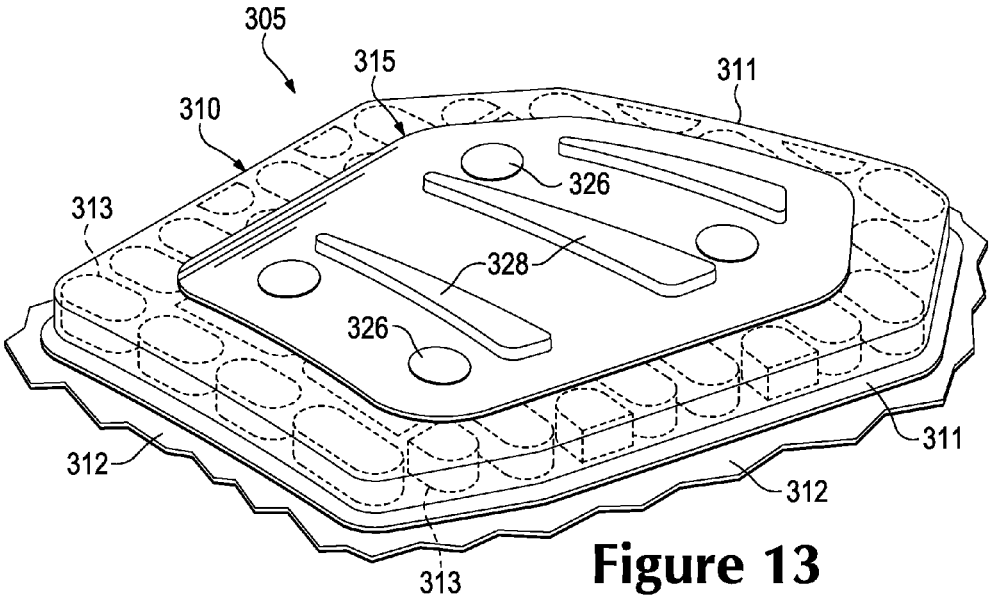
FIG. 13 is a perspective view of a protective component of the inner garment.
Figure 14:
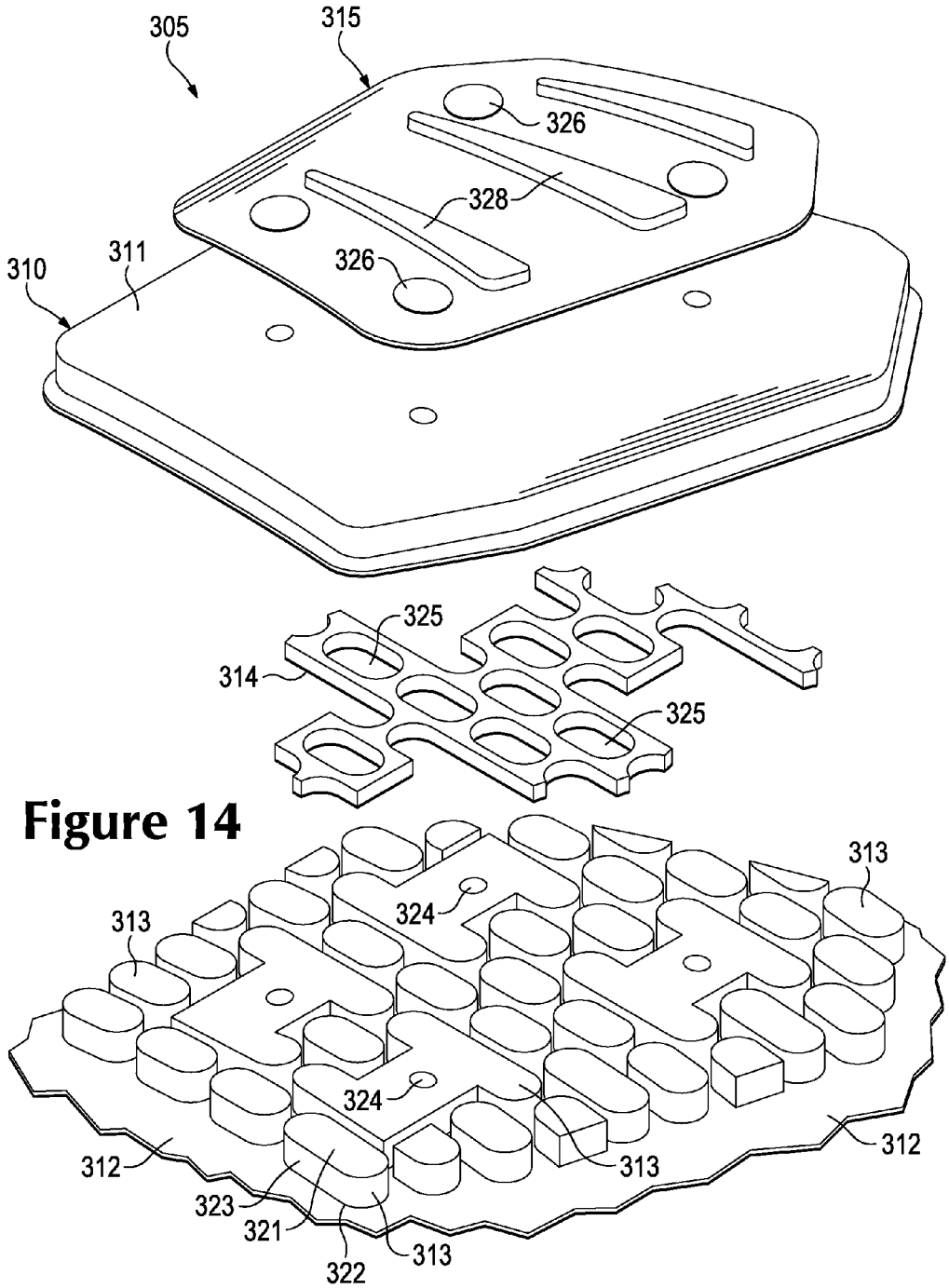
FIG. 14 is an exploded perspective view of the protective component.
Figure 15:
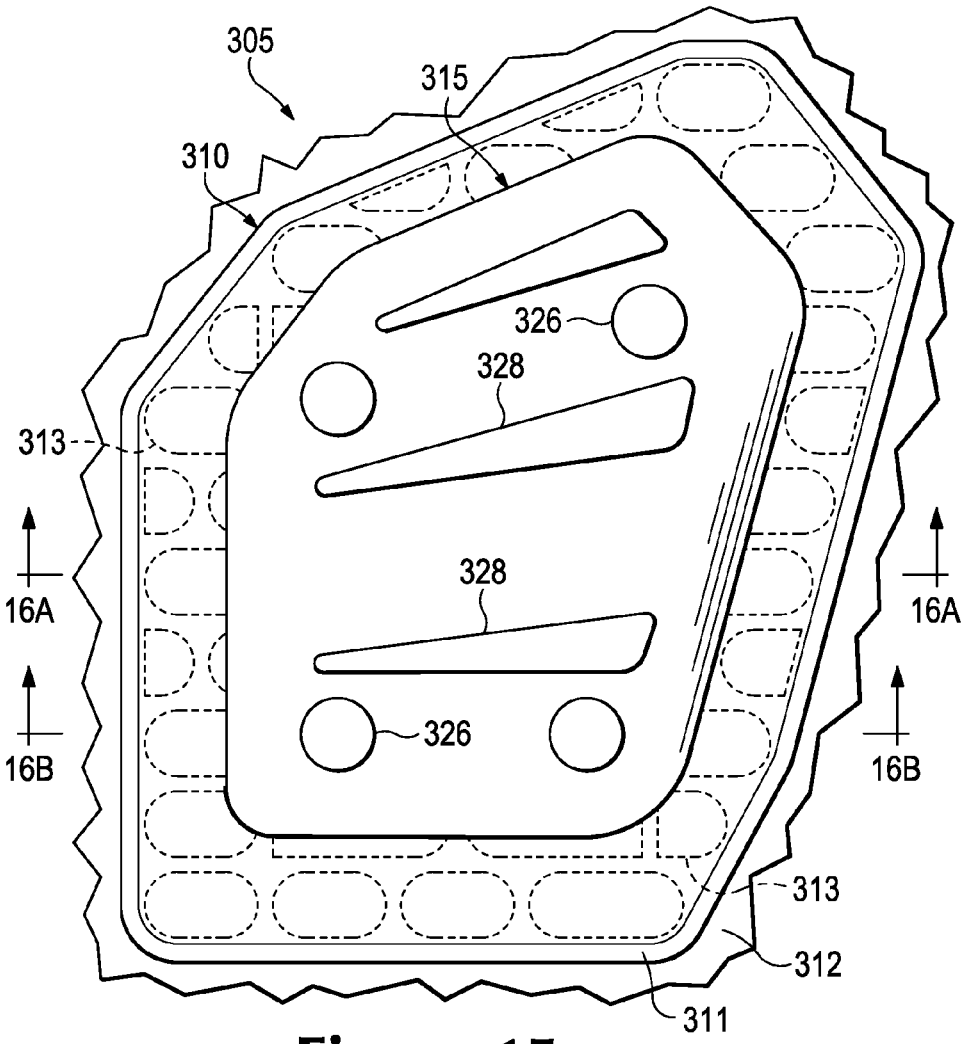
FIG. 15 is a top plan view of the protective component.

One of cover components 210 is depicted in the cross-sectional views of FIGS. 7A and 7B as including a first material layer 211, a second material layer 212, and a pad 213. In general, pad 213 is positioned between and secured to first material layer 211 and second material layer 212. Material layers 211 and 212 cooperatively form an outer surface or covering for protective elements 210. That is, material layers 211 and 212 cooperatively form a pocket or void, in which pad 213 is located. Whereas second material layer 212 is depicted as having a generally planar configuration, first material layer 211 extends over pad 213 and also along sides of pad 213 to join with second material layer 212 (e.g., through stitching, an adhesive, or thermal bonding). Although cover component 210 may be incorporated into outer garment 200 in a variety of ways, first material layer 211 may be positioned exterior of second material layer 212. That is, first material layer 211 may form a portion of an exterior surface of outer garment 200, whereas second material layer 212 may form a portion of an interior surface of outer garment 200. An advantage to this configuration is that cover component 210 protrudes outward from outer garment 200, rather than protruding inward and toward individual 10. In some configurations of outer garment 200, however, cover component 210 may protrude inward.

A thickness of pad 213 may vary depending upon various factors, including the type of material utilized for pad 213 and the desired level of protection. In general, however, the thickness of pad 213 may range from one to fifty millimeters or more when formed from a polymer foam material. Although pad 213 may exhibit a constant thickness between material layers 211 and 212, the thickness may vary across the width of pad 213. For example, edges of pad 213 may be thinner than central areas of pad 213. Various apertures, gaps, and indentations may also be formed in pad 213 to enhance flexibility and breathability.

A variety of materials may be utilized for first material layer 211 and second material layer 212, including various textiles, polymer sheets, leather, or synthetic leather, for example. Combinations of these materials (e.g., a polymer sheet bonded to a textile) may also be utilized for material layers 211 and 212. Although material layers 211 and 212 may be formed from the same material, each of material layers 211 and 212 may also be formed from different materials. With regard to textiles, material layers 211 and 212 may be formed from knitted, woven, or non-woven textile elements that include rayon, nylon, polyester, polyacrylic, cotton, wool, or silk, for example. Moreover, the textiles may be non-stretch, may exhibit one-directional stretch, or may exhibit multi-directional stretch. Accordingly, a variety of materials are suitable for first material layer 211 and second material layer 212.

Pads 213 may also be formed from a variety of materials, including various polymer foam materials that return to an original shape after being compressed. As an alternative to polymer foam materials, pads 213 may also be formed as fluid-filled chambers. Examples of suitable polymer foam materials for pads 213 include polyurethane, ethylvinylacetate, polyester, polypropylene, and polyethylene foams. Moreover, both thermoplastic and thermoset polymer foam materials may be utilized. In some configurations of cover components 210, pads 213 may be formed from a polymer foam material with a varying density, or solid polymer or rubber materials may be utilized. Also, different pads 213 may be formed from different materials, or may be formed from similar materials with different densities. Additional articles of apparel having features that may be utilized in outer apparel 200 or for pads 213 are disclosed in U.S. patent application Ser. No. 11/620,950, filed 8 Jan. 2007 and entitled Athletic Garment With Articulated Body Protective Underlayer, which is entirely incorporated herein by reference.

The polymer foam materials forming pads 213 of cover components 210 attenuate impact forces to provide protection. When incorporated into apparel system 100 and outer garment 200, the polymer foam materials of pads 213 may compress to protect a wearer from contact with other athletes, equipment, or the ground. Accordingly, cover components 210 may be utilized to provide protection to areas of individual 10 that are covered by cover component 210. As discussed above, cover components 210 may overlap, extend over, or otherwise coincide with the positions of some protective components 305 of inner garment 300. In this position, cover components 210 may be utilized to provide protection to other athletes or individuals from relatively hard or rigid materials (e.g., a plate) incorporated into protective components 305.

Inner Garment Configuration

Inner garment 300, which incorporates protective components 305, is depicted individually in FIGS. 8-12 as including a pelvic region 301 and a pair of leg regions 302 that extend outward or downward from pelvic region 301. Pelvic region 301 corresponds with the pelvic area of individual 10 and extends over at least a portion of the pelvic area when worn. Pelvic region 301 also corresponds with pelvic region 201 of outer garment 200 and is generally located between pelvic region 201 and individual 10 when worn. An upper portion of pelvic region 301 defines a waist opening 303 that extends around a waist of individual 10 when outer garment 300 is worn. Leg regions 302 correspond with a right leg and a left leg of individual 10 and cover at least a portion of the right leg and the left leg when worn. Leg regions 302 also correspond with leg regions 202 of outer garment 200 and are generally located between leg regions 202 and individual 10 when worn. Lower portions of leg regions 302 each define a thigh opening 304 that extends around a thigh of individual 10 when inner garment 300 is worn.

Protective components 305 are incorporated into various areas of inner garment 300 to impart padding, cushioning, or otherwise attenuate impact forces, thereby imparting protection to individual 10. More particularly, two of protective components 305 are located in a front area of leg regions 302, two of protective components 305 are located on sides of pelvic region 301, and one of protective components 305 is in a back of pelvic region 301. In further configurations of apparel system 100 or inner garment 300, protective components 305 may be positioned in various areas of inner garment 300, including the sides or back of leg regions 302 or other areas of pelvic region 301, to protect specific portions (e.g., muscles, bones, joints, impact areas) of individual 10. Additionally, the quantity, shapes, sizes, and other properties of protective components 305, as well as the materials utilized in protective components 305, may vary significantly to provide a particular level of protection to the specific portions of individual 10.

As discussed above, cover components 210 of outer garment 200 may overlap, extend over, or otherwise coincide with the positions of some protective components 305. Although outer garment 200 may cover substantially all of inner garment 300 and the various protective components 305, only the upper cover components 210 coincide in location and extend over the two protective components 305 in the front area of leg regions 302. In further configurations of apparel system 100, however, additional cover components 210 may extend over other protective components 305.

Protective Element Configurations

An example configuration for one of protective components 305 is depicted in FIGS. 13-17B as including a cushioning element 310 and a plate element 315. Cushioning element 310 includes a first material layer 311, a second material layer 312, a plurality of pads 313, a frame 314, and a plate element 315. In general, pads 313 and frame 314 are positioned between first material layer 311 and second material layer 312. Although pads 313 are secured to first material layer 311 and second material layer 312, frame 314 is unsecured to each of first material layer 311, second material layer 312, and pads 313. Additionally, plate element 315 is located at an exterior of cushioning element 310 (i.e., located exterior of first material layer 311). Although each cushioning element 310 in the front area of leg regions 302 incorporate one of plate elements 315, further plates are absent from other cushioning elements 310. In further configurations, additional plate elements 315 may be utilized in the other cushioning elements 310.

First material layer 311 and second material layer 312 cooperatively form an outer surface or covering for cushioning element 310, with plate element 315 being secured to the outer surface. That is, first material layer 311 and second material layer 312 cooperatively form a pocket or void, in which pads 313 and frame 314 are located. Whereas second material layer 312 is depicted as having a generally planar configuration, first material layer 311 extends over pads 313 and frame 314 and also along sides of pads 313 to join with second material layer 312 (e.g., through stitching, an adhesive, or thermal bonding). Although cushioning element 310 may be incorporated into inner garment 300 in a variety of ways, first material layer 311 may be positioned exterior of second material layer 312. That is, first material layer 311 may form a portion of an exterior surface of inner garment 300, whereas second material layer 312 may form a portion of an opposite interior surface of inner garment 300. An advantage to this configuration is that cushioning element 310 protrudes outward from inner garment 300, rather than protruding inward and toward individual 10. In some configurations of inner garment 300, however, cushioning element 310 may protrude inward. Any of the various materials discussed above for material layers 211 and 212 may be utilized for first material layer 311 and second material layer 312.

Pads 313 are located between and secured to each of material layers 311 and 312. Each of pads 313 has a first surface 321 secured to first material layer 311, an opposite second surface 322 secured to second material layer 312, and a side surface 323 that extends between surfaces 321 and 322. Although the shapes of pads 313 may vary significantly, many of surfaces 321 and 322 are depicted as having an elliptical or generally elongate shape with rounded end areas, and side surface 323 extends in a generally straight fashion between surfaces 321 and 322. Pads 313 are spaced evenly from each other and arranged in offset rows. Moreover, pads 313 are generally discrete elements that are spaced from each other, but may also be connected or formed as a one-piece unit. Given that cushioning element 310 is depicted as having a generally pentagonal configuration, various pads 313 around a perimeter of cushioning element 310 exhibit a truncated or partial configuration. Some of pads 313 also define apertures 324 that receive elements for securing plate element 315, and these pad components may be larger than other pad components 315. A variety of materials may be utilized for pads 313, including any of the various materials discussed above for pad 213, such as polymer foam materials and fluid-filled chambers.

Each of pads 313 are depicted as having the same thickness (i.e., distance between surfaces 321 and 322), which may range from one to fifty millimeters or more when formed from a polymer foam material. As an alternative, pads 313 may exhibit varying thicknesses. For example, a group of pads 313 located in a central area of cushioning element 310 may exhibit a maximum thickness, a group of pads 313 located around the central area may exhibit a medium thickness, and a group of pads 313 located adjacent to a periphery of cushioning element 310 may exhibit a minimum thickness. A configuration of a cushioning element with varying thicknesses is disclosed in U.S. Provisional Patent Application Ser. No. 61/158,653, filed 9 Mar. 2009 and entitled Cushioning Elements For Apparel And Other Products, which is entirely incorporated herein by reference.

Frame 314 is located between each of material layers 311 and 312. In contrast with pads 313, frame 314 is unsecured to each of first material layer 311 and second material layer 312, and frame 314 is also unsecured to pads 313. This configuration permits frame 314 to float or otherwise move relative to first material layer 311, second material layer 312, and pads 313. Frame 314 defines a plurality of apertures 325 having the general shape of pads 313. Given this configuration, frame 314 extends around and between various pads 313. In areas where frame 314 is present, the combination of pads 313 and frame 314 effectively forms a foam layer within cushioning element 310. Although the dimensions of apertures 325 may substantially match the dimensions of pads 313, frame 314 may also be formed such that a gap extends between edges of apertures 325 and side surfaces 233 of pads 313. Any of the variety of materials discussed above as being suitable for pads 213 and 313 may also be utilized for frame 314.

Frame 314 is depicted as being located in the central area of cushioning element 310. As an alternative, frame 314 may extend (a) throughout cushioning element 310 and define apertures 325 that extend around all of pads 313, (b) around other pads 313, or (c) through other areas of cushioning element 310. Additionally, frame 314 may extend to the periphery of cushioning element 310 in some areas, but not in other areas. Accordingly, the portions of cushioning element 310 into which frame 314 extends may vary significantly.

Figure 16A:
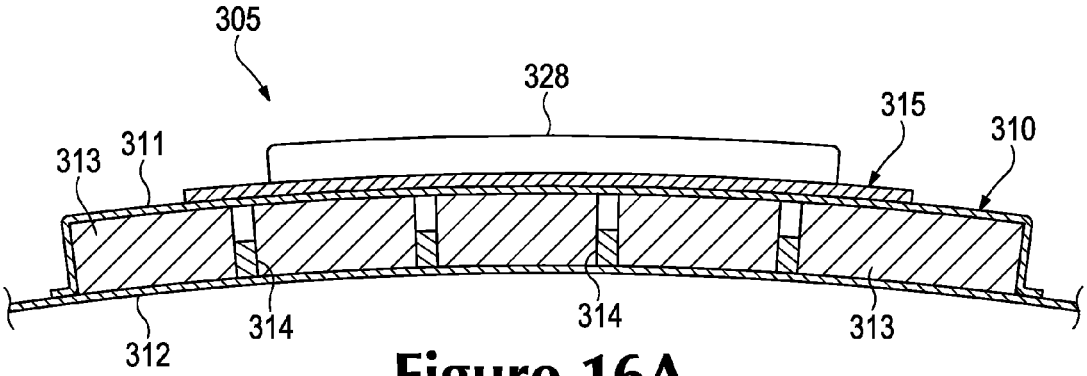
FIGS. 16A and 16B are cross-sectional views of the protective component, as defined by section lines 16A and 16B in FIG. 15.
Figure 16B:
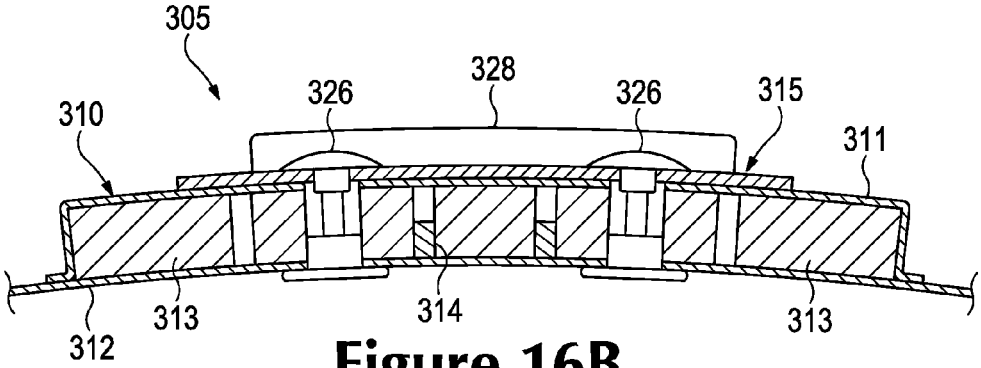
Figure 17A:
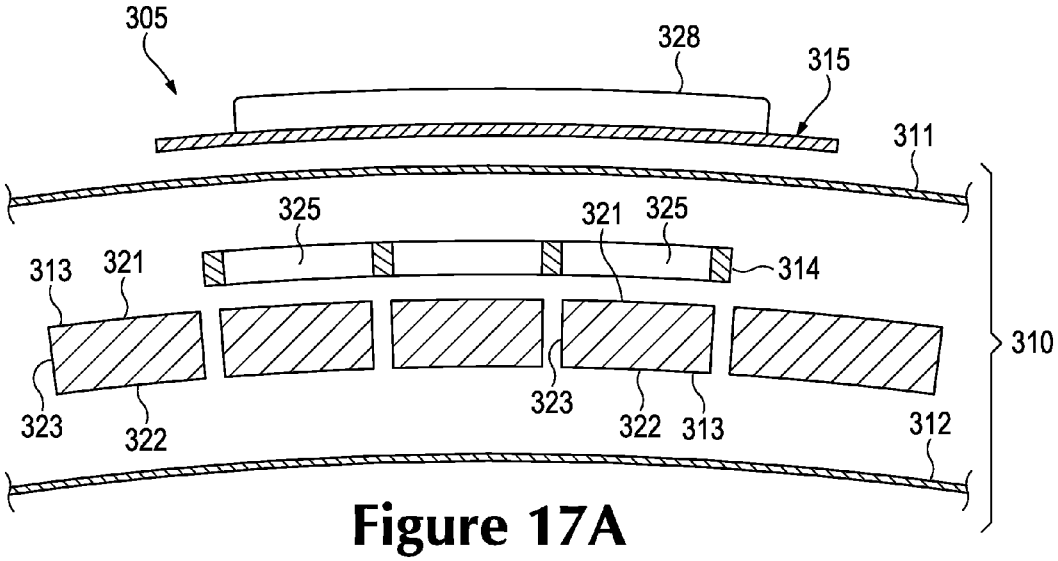
FIGS. 17A and 17B are exploded cross-sectional views respectively corresponding with the cross-sectional views of FIGS. 16A and 16B.
Figure 17B:
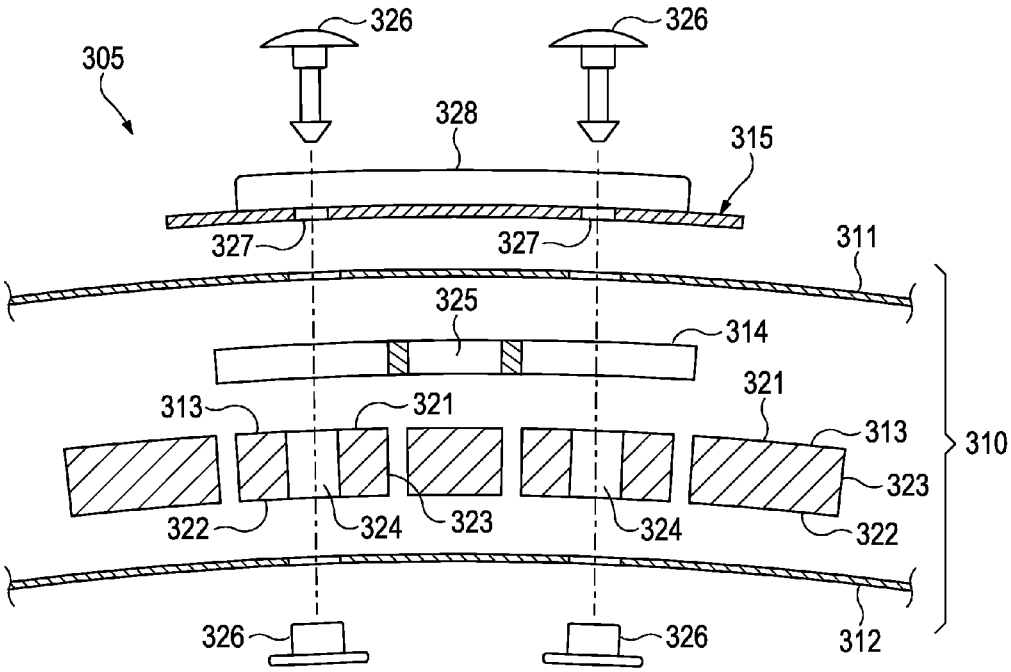

Referring to the cross-sectional views of FIGS. 16A and 16B, for example, frame 314 is depicted as exhibiting lesser thickness than each of pads 313. An advantage of this configuration is that frame 314 may move relative to material layers 311 and 312, thereby enhancing the flexibility of cushioning element 310. As an example, frame 314 may have a thickness of approximately two millimeters in a configuration wherein the pads 313 exhibit a thickness of five millimeters. In other configurations, the thickness of frame 314 may range from one to fifty millimeters or more. Although frame 314 may exhibit lesser thickness than pads 313, frame 314 may also be thicker than pads 313.

A variety of methods may be utilized to manufacture cushioning element 310. In general, the methods include bonding (e.g., adhesive or thermal bonding) each of pads 313 to material layers 311 and 312. Examples of suitable manufacturing processes are disclosed in (a) U.S. patent application Ser. No. 12/755,579, which was filed in the U.S. Patent and Trademark Office on 7 Apr. 2010 and entitled Method Of Manufacturing Cushioning Elements For Apparel And Other Products; (b) U.S. patent application Ser. No. 13/035,570, which was filed in the U.S. Patent and Trademark Office on 25 Feb. 2011 and entitled Cushioning Elements For Apparel And Other Products And Methods Of Manufacturing The Cushioning Elements; and (c) U.S. patent application Ser. No. 13/035,592, which was filed in the U.S. Patent and Trademark Office on 25 Feb. 2011 and entitled Articles Of Apparel Incorporating Cushioning Elements And Methods Of Manufacturing The Articles Of Apparel, each of which are entirely incorporated herein by reference.

Plate element 315 is positioned exterior of material layers 311 and 312, pads 313, and frame 314. Whereas pads 313 and frame 314 are located between material layers 311 and 312, plate element 315 is located on an opposite side of first material layer 311 and forms a portion of an exterior surface of inner garment 300 and protective component 305. As described in greater detail below, plate element 315 has a semi-rigid structure that distributes impact forces over pads 313 to impart protection to individual 10 or another wearer.

Various securing elements 326 are utilized to secure plate element 315 to cushioning element 310. Securing elements 326 extend through apertures 327 in plate element 315 and also extend through corresponding apertures 324 in selected pads 313, as well as holed in material layers 311 and 312. Although securing elements 326 are depicted as having the general configuration of rivets, various snap-fit securing mechanisms, adhesive or thermal bonding, or stitching may be utilized to join plate element 315. In some configurations, plate element 315 may also be secured with a hook-and-loop fastener that permits plate element 315 to be separated, repositioned, or replaced.

Plate element 315 has an overall curved configuration that generally conforms with a shape of individual 10. Given that protective component 305 may be utilized to protect a thigh of individual 10, plate element 315 may exhibit a curvature that corresponds with the thigh. Additionally, plate element 315 may include various ribs 328 that enhance rigidity. In further configurations, plate element 315 may have a variety of other features that enhance the comfort or protective properties of apparel system 100 or protective component 305. For example, plate element 315 may define a plurality of apertures that enhance breathability or flexibility, plate element 315 may be formed from multiple materials that vary the rigidity or flexibility in different areas, or plate element 315 may have a varying thickness that also vary the rigidity or flexibility in different areas.

Plate element 315 is depicted as having lesser area than first material layer 211. In this configuration, some of pads 313 are located adjacent to plate element 315 (i.e., covered by plate element 315), and some of pads 313 are located around a periphery of plate element 315. That is, plate element 315 only covers a central portion of pads 313, but effectively exposes peripheral portions of pads 313. Forming plate element 315 in this manner imparts a varying thicknesses to cushioning element 310. An advantage of three varying thicknesses relates to the comfort of apparel system 100 and the integration of inner garment 300 with other articles of apparel (e.g., outer garment 200) or other articles of equipment. The lesser thickness of the periphery of cushioning element 310 imparts a lower profile at the periphery. Given the lower profile, portions of cushioning element 310 at the periphery may be less noticeable to individual 10 and may interfere less with the other articles of apparel or equipment. Moreover, plate element 315 may have a conventional size, but the protective properties of pads 313 may extend beyond plate element 315 to cover further and larger areas of individual 10.

As a comparison with the compressible polymer foam material forming pads 313 and frame 314, plate element 315 may be formed from a semi-rigid or rigid polymer material with greater stiffness and density than the polymer foam material. As another comparison, whereas pads 313 and frame 314 may be formed from a polymer foam material, plate element 315 may include a non-foamed polymer material. Examples of suitable polymer materials for plate element 315 include polyethylene, polypropylene, acrylonitrile butadiene styrene, polyester, thermoset urethane, thermoplastic urethane, polyether block amide, polybutylene terephthalate various nylon formulations, or blends of these materials. Composite materials may also be formed by incorporating glass fibers, aramid fibers, or carbon fibers, for example, into the polymer materials discussed above in order to enhance the strength and rigidity of plate element 315. In some configurations, plate element 315 may also be formed from metal materials (e.g., aluminum, titanium, steel) or may include metal elements that enhance the strength and rigidity of plate element 315. Accordingly, a variety of materials may be utilized for plate element 315.

Cushioning element 310 and plate element 315 cooperatively impart protection to individual 10. An impact force contacting plate element 315, for example, is distributed over many of pad components 314, which cushion or otherwise attenuate the impact force. That is, the rigid or semi-rigid polymer material forming plate element 315 distributes impact forces, and the compressible polymer foam materials of pads 313 impart cushioning or otherwise attenuate the impact forces. When incorporated into apparel system 100 cover components 210 from outer garment 200 impart further attenuation of the impact forces and may assist with protecting other individuals.

In addition to distributing and attenuating impact forces, protective component 305 has an advantage of simultaneously providing one or more of breathability, a relatively low overall mass, and launderability. When used for athletic activities, individual 10 may perspire and generate excess heat. By utilizing a permeable textile for material layers 311 and 312 and also forming gaps between adjacent pads 313 and areas between pads 313 and frame 314, areas for air to enter the apparel and for moisture to exit the apparel are formed through cushioning element 310. More particularly, air and moisture may pass through material layers 311 and 312, between pads 313 in areas where frame 314 is absent, and between pads 313 and frame 314 in areas where frame 314 is present to impart breathability to areas of the apparel having cushioning element 310. Moreover, the materials and structure discussed above for cushioning element 310 impart a low overall mass to cushioning element 310. Furthermore, the materials and structure discussed above for cushioning element 310 permits cushioning element 310 to be laundered without significant shrinkage or warping, even when temperatures associated with commercial laundering processes are utilized. Accordingly, cushioning element 310 may simultaneously provide impact force distribution, impact force attenuation, breathability, a relatively low overall mass, and launderability to apparel system 100.

The combination of garments 200 and 300 effectively form a layered structure that includes material layers 211, 212, 311, and 312; pads 213 and 313; frame 314; and plate element 315. The layered structure has a configuration wherein plate elements 315 are located between polymer foam materials. More particularly, plate elements 315 are located between each of pads 213 and 313, as well as frame 314. As discussed above, cover components 210 may overlap, extend over, or otherwise coincide with the positions of some cushioning elements 310 of inner garment 300, and cover components 210 may be utilized to provide protection to other athletes or individuals from the relatively hard or rigid materials of cushioning elements 310. In apparel system 100, cover components 210 overlap only the cushioning elements 310 that incorporate plate elements 315. Given that plate elements 315 from relatively hard or rigid materials, cover components 210 may be utilized to provide protection to other athletes or individuals from plate elements 315. Moreover, pads 213 may have a greater area than plate elements 315 such that pads 213 completely cover plate elements 315. Even if components 210 and 305 move relative to each other, the larger pads 213 may remain in an overlapping configuration with plate elements 315 to continue providing protection to other athletes or individuals from plate elements 315.

Further Configurations

Aspects of protective components 305 may vary, depending upon the intended use for protective components 305, the types of apparel that protective components 305 are used in, and their locations within apparel, for example. Moreover, changes to the dimensions, shapes, and materials utilized within protective components 305 may vary the overall properties of protective components 305. That is, by changing the dimensions, shapes, and materials utilized within protective components 305, the compressibility, impact force attenuation and distribution, breathability, flexibility, and overall mass of protective components 305 may be tailored to specific purposes or types of apparel. A plurality of variations for protective components 305 are discussed below. Any of these variations, as well as combinations of these variations, may be utilized to tailor the properties of protective components 305 to an intended use or particular product. Moreover, any of the various configurations disclosed in U.S. Provisional Patent Application Ser. No. 61/158,653, which was previously entirely incorporated herein by reference, may be utilized for cushioning element 310.

Figure 18A:
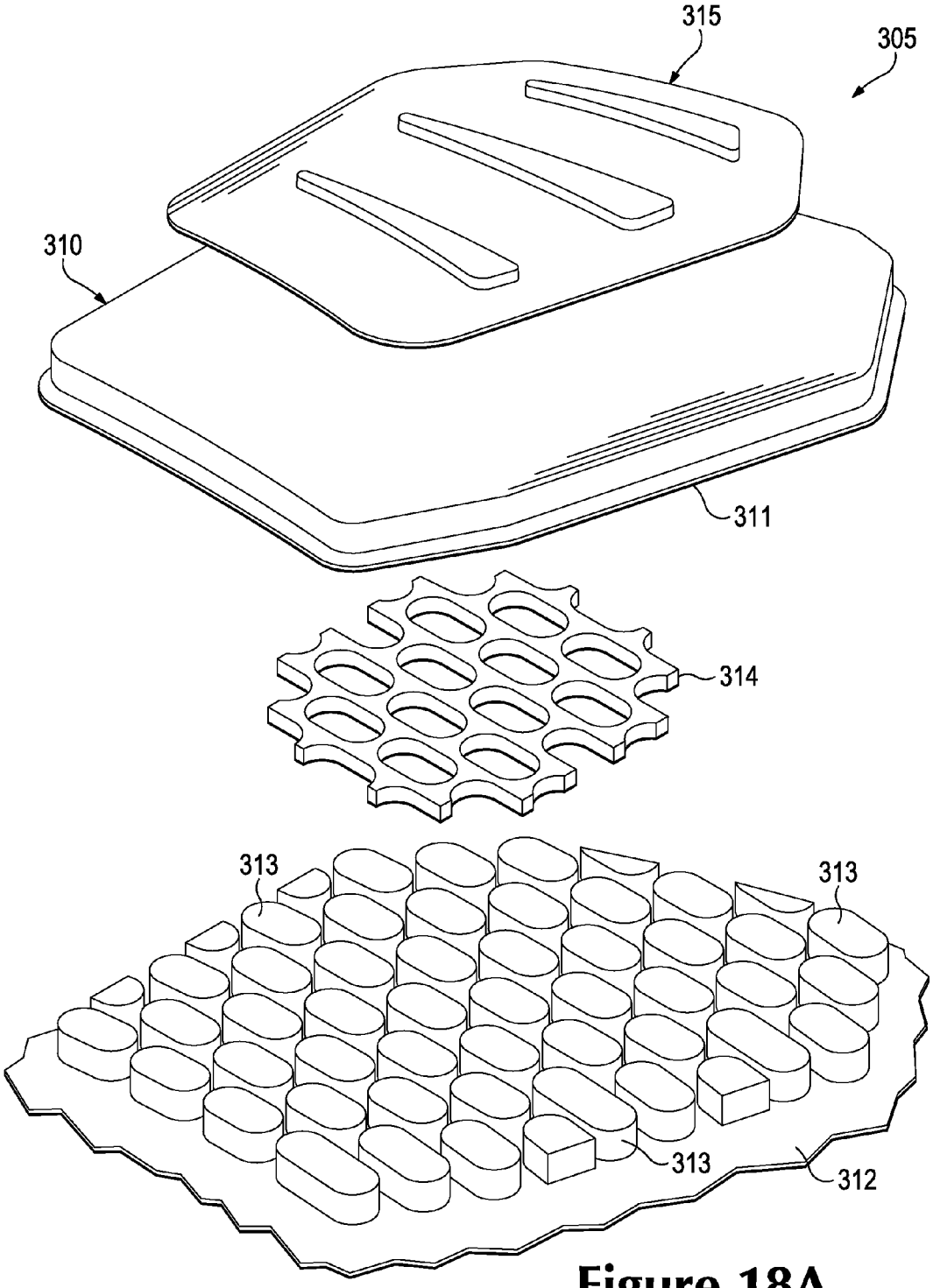
FIGS. 18A-18F are exploded perspective views corresponding with FIG. 14 and depicting further configurations of the protective component.
Figure 18B:
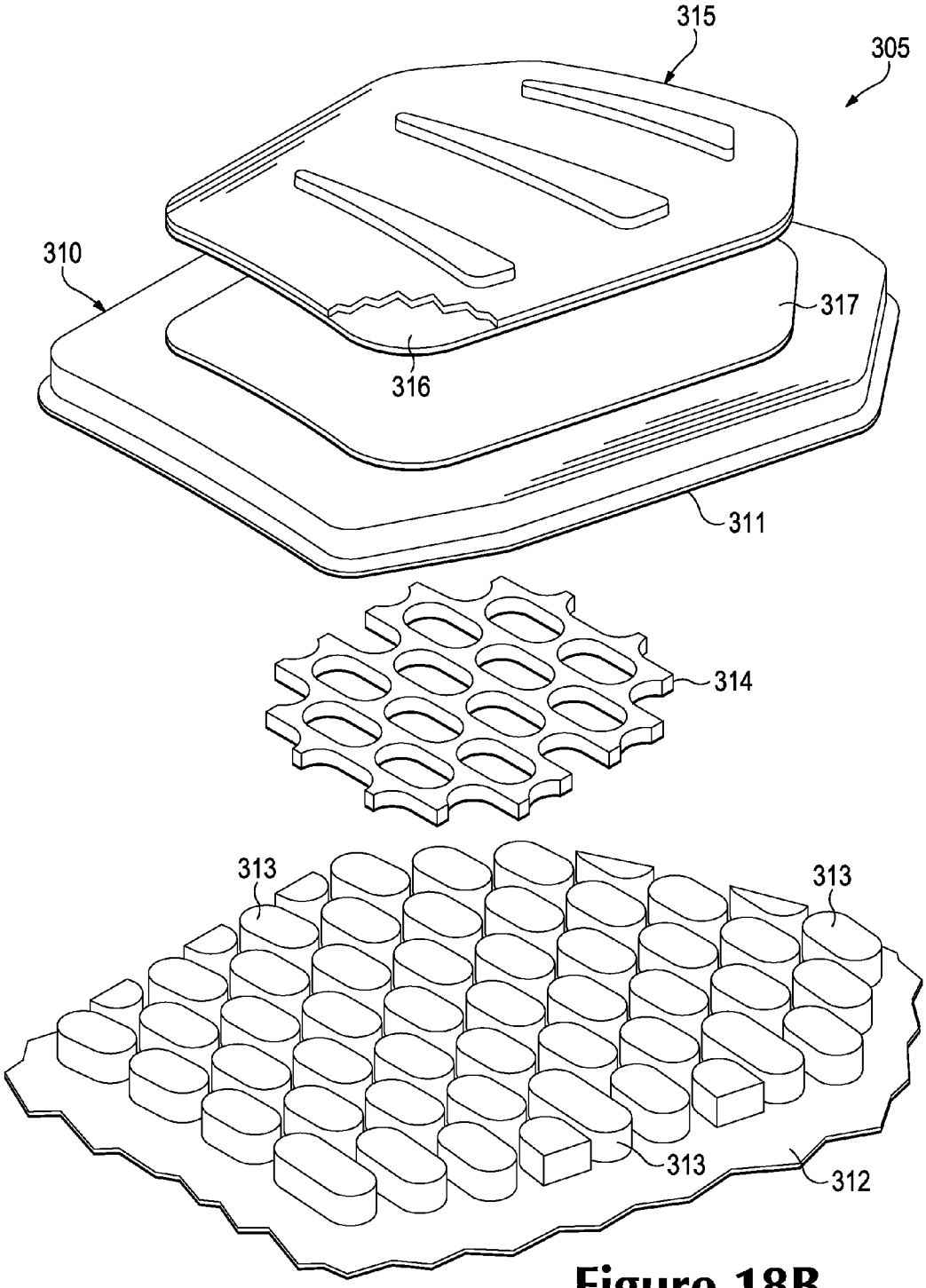
Figure 18C:
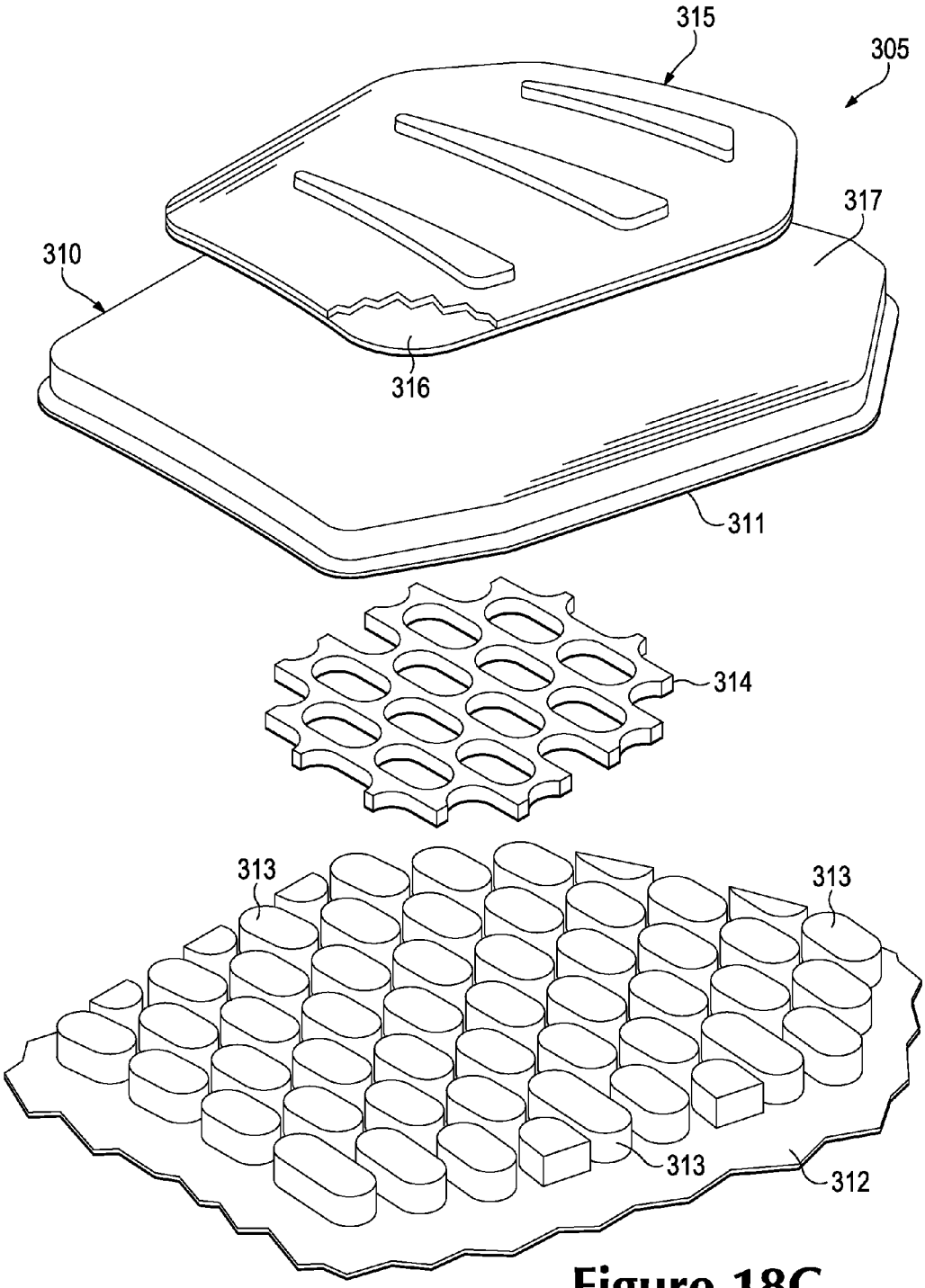

A further configuration of protective components 305 is depicted in FIG. 18A, wherein securing elements 326 are absent. In this configuration, each of pads 313 have similar shapes and do not define apertures (i.e., apertures 324) for receiving securing elements 326. In order to secure plate element 315, adhesive bonding, thermal bonding, or stitching may be utilized. In other configurations, a hook-and-loop fastener system may be utilized to join plate element 315 to cushioning element 310. Referring to FIG. 18B, for example, a first part 316 of a hook-and-loop fastener system is secured to an underside of plate element 315 and a second part 317 of the hook-and-loop fastener system is secured to an exterior of first material layer 311. As another example, FIG. 18C depicts a similar configuration where first material layer 311 incorporates or is formed by second part 317 of the hook-and-loop fastener system. That is, first material layer 311 may be second part 317 of the hook-and-loop fastener system.

An advantage of utilizing the hook-and-loop fastener system is that plate element 315 may be easily separated, repositioned, or replaced with another plate having a different configuration (e.g., shape, thickness, flexibility). That is, parts 316 and 317 may be separated from each other and then rejoined following repositioning or replacement. Although parts 316 and 317 are depicted as having a size and shape of plate element 315 in FIG. 18B, either of both of parts 316 and 317 may have any shape or size that facilitates joining and separating plate element 315 from cushioning element 310. Moreover, cushioning element 310 may be used to impart cushioning and protection without plate element 315 during some activities, and then plate element 315 may be rejoined to cushioning element 310 for other activities. Accordingly, the presence of the hook-and-loop fastening system provides configurability and variability to the use of apparel system 100.

Figure 18D:
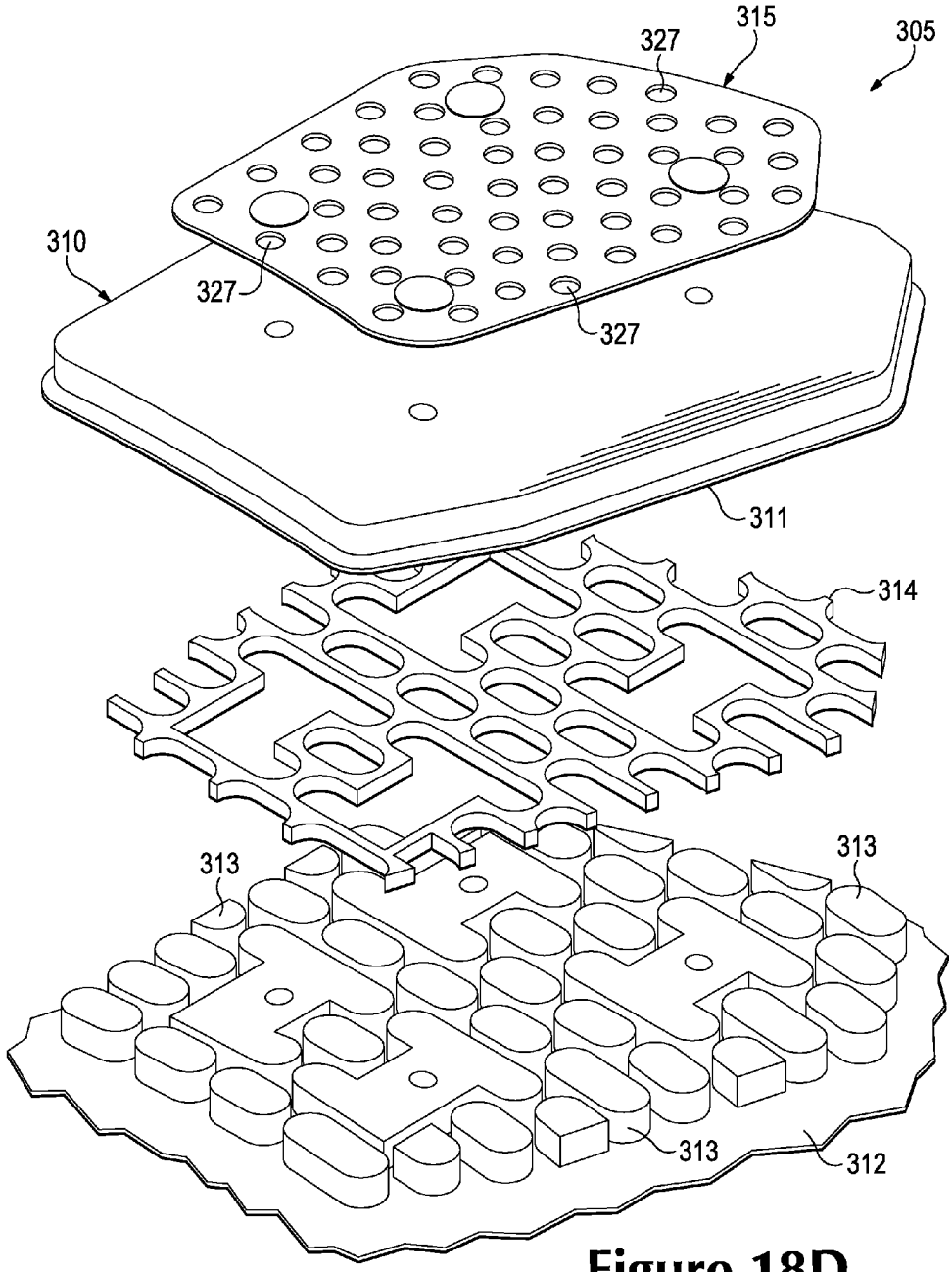
Figure 18E:
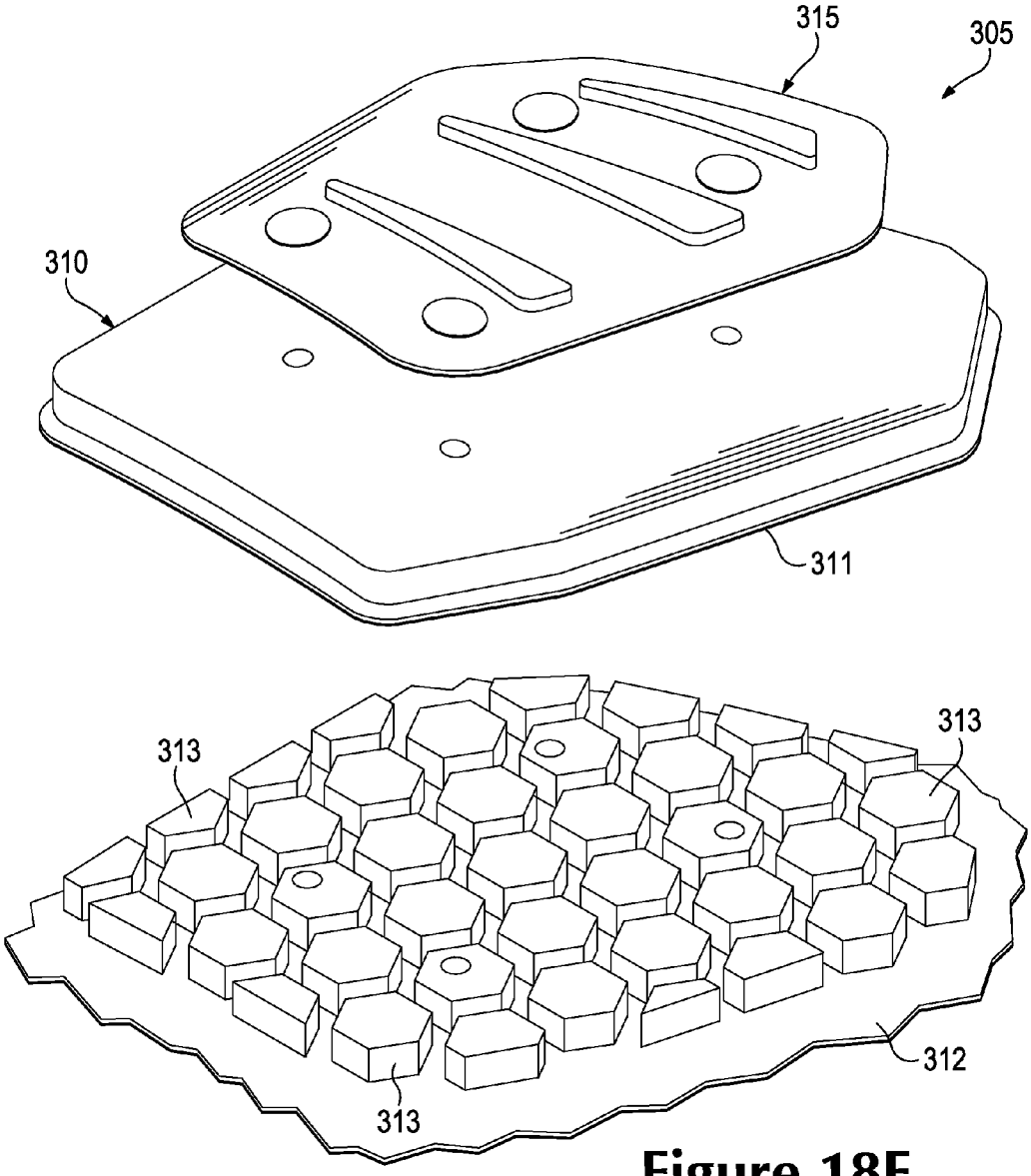
Figure 18F:
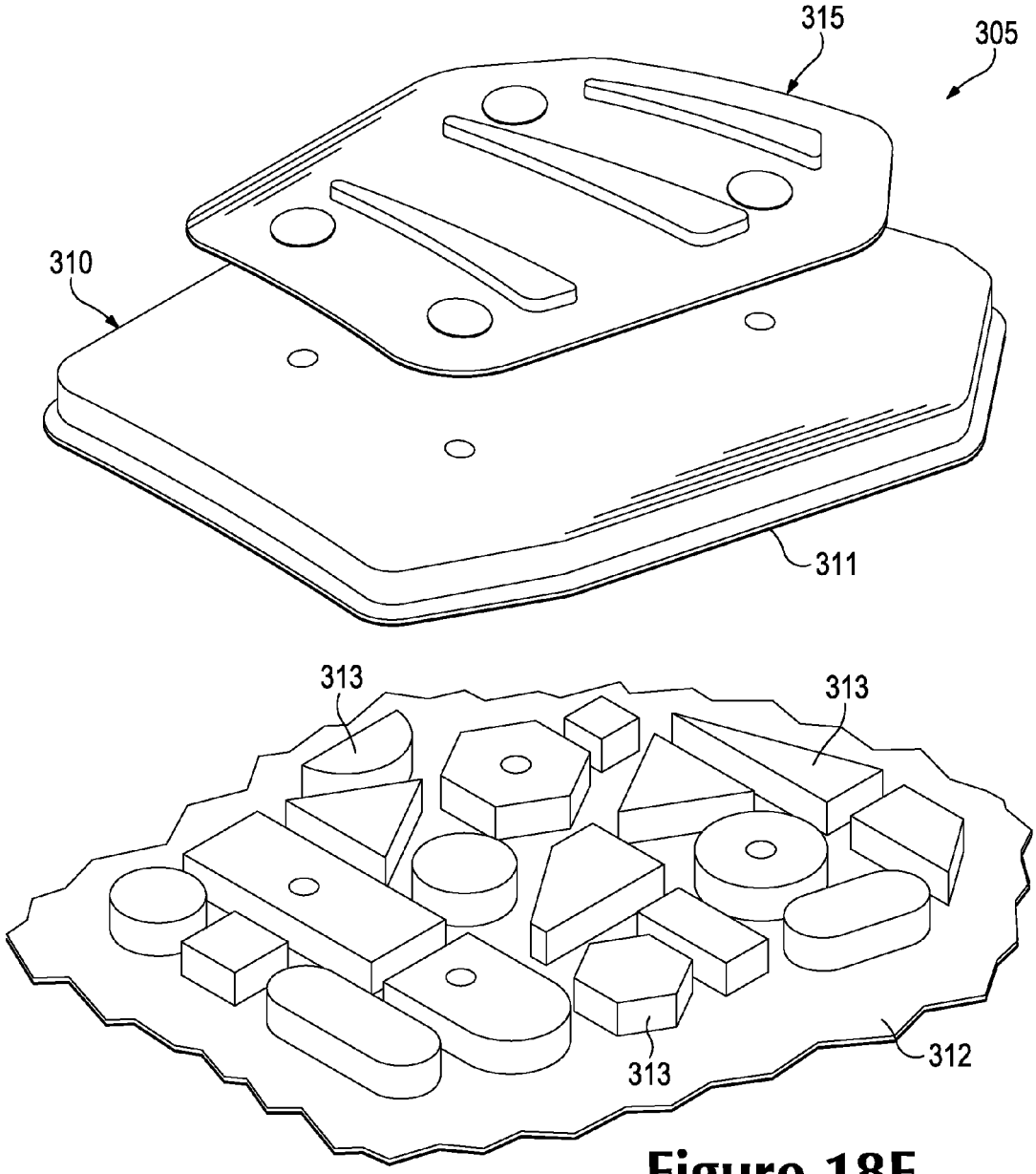

Further configurations of protective components 305 may include a variety of additional features. As depicted in FIG. 18D, ribs 328 are absent from plate element 315 and a plurality of apertures 327 extend through plate element 315. Advantages of the various apertures 327 are that the flexibility and breathability of plate element 315 may be increased. Pads 313 are discussed above as having an elliptical or generally elongate shape with rounded end areas. Pads 313 may, however, have a variety of other shapes, including hexagonal shapes, as depicted in FIG. 18E. Pads 313 may also have a variety of other shapes, such as round shapes, triangular shapes, rectangular shapes, or irregular shapes. Pads 313 may also have a mixture of different shapes, as depicted in FIG. 18F. Additionally, frame 314 may be absent from some configurations, as also depicted in FIGS. 18E and 18F.

Figure 19A:
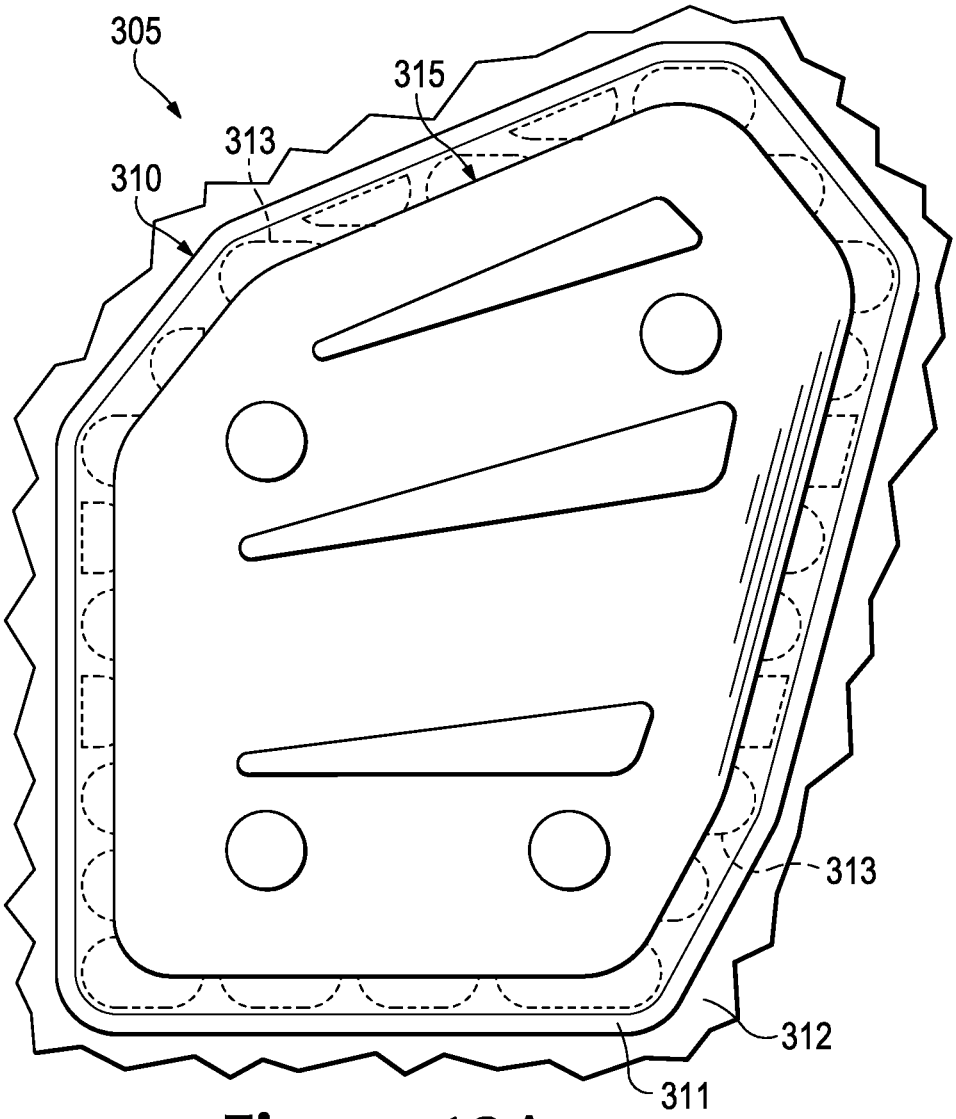
FIGS. 19A-19E are top plan views corresponding with FIG. 15 and depicting further configurations of the protective component.
Figure 19B:
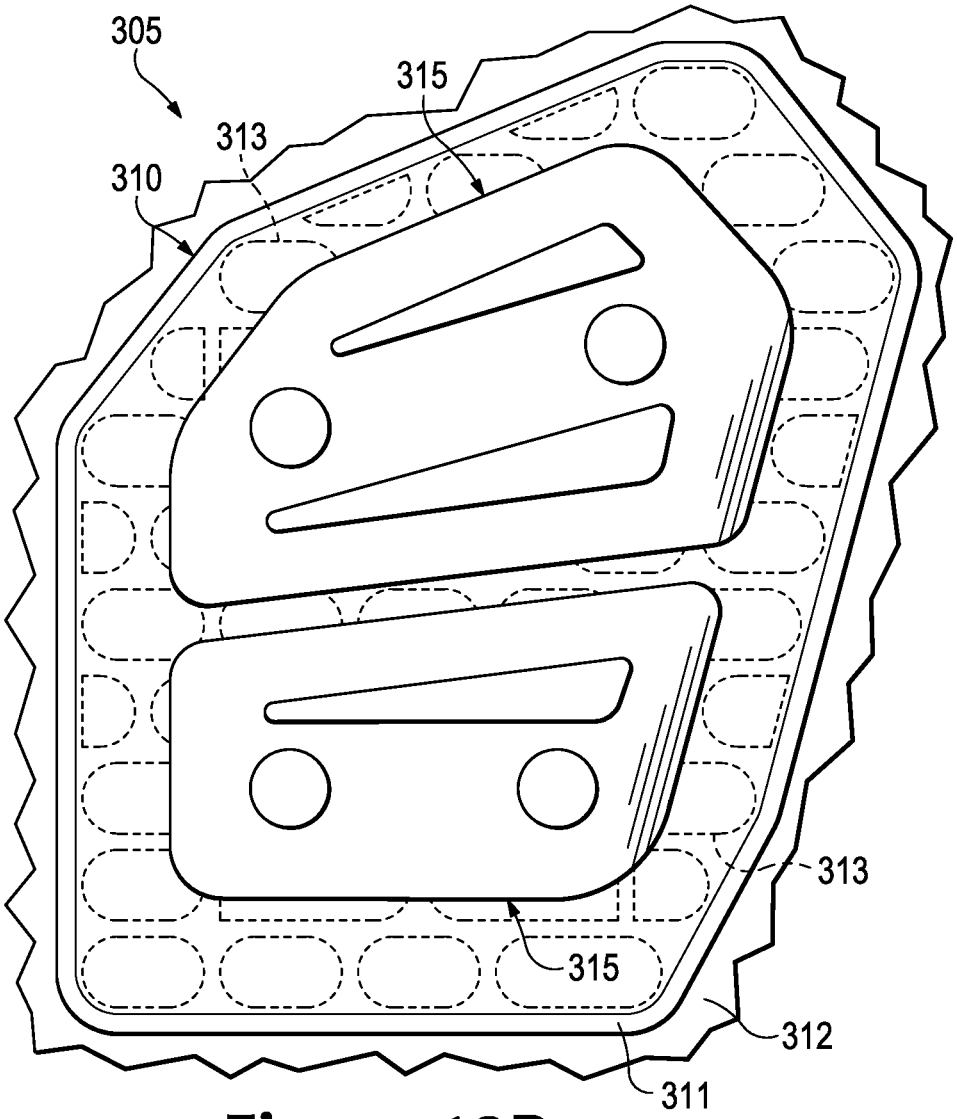
Figure 19C:
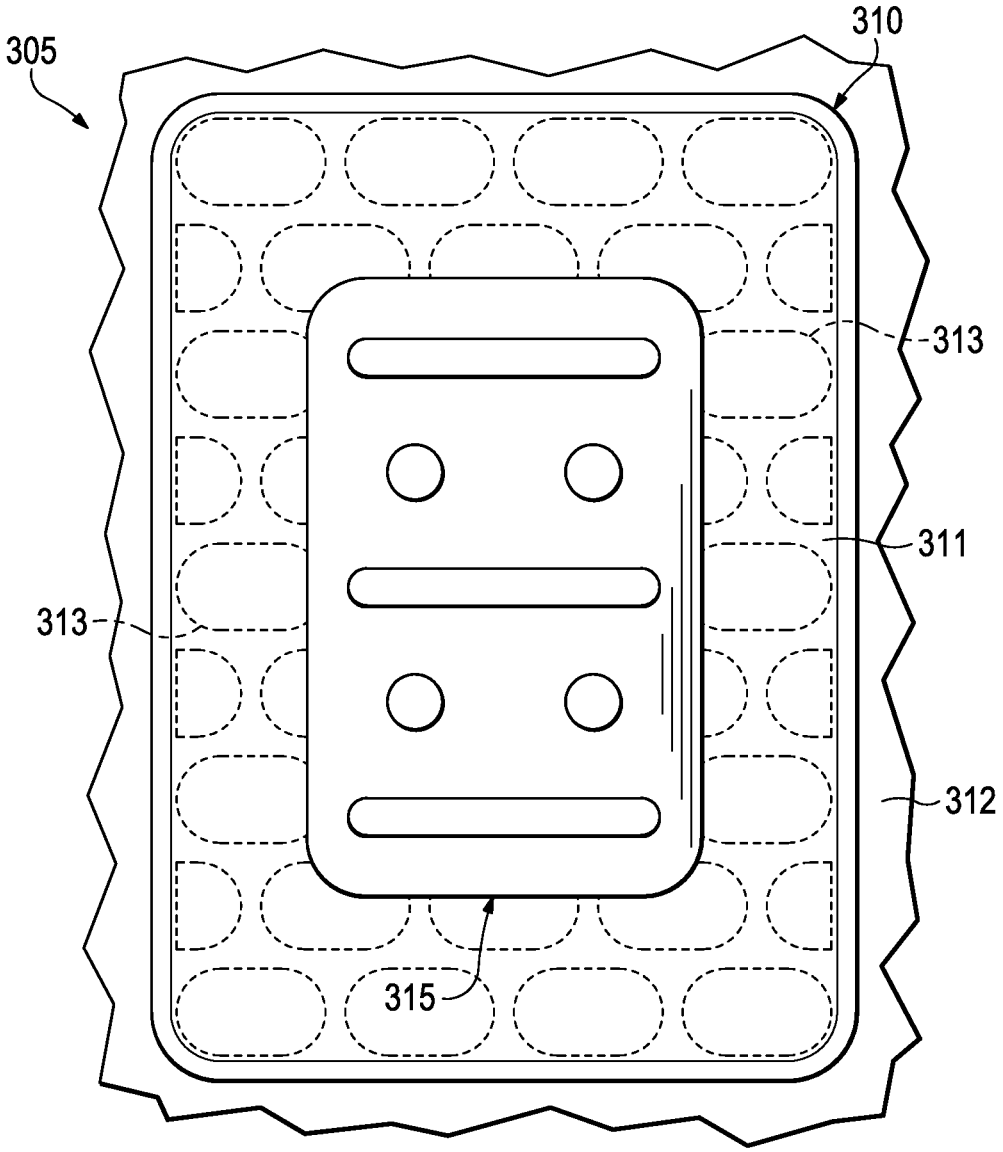
Figure 19D:
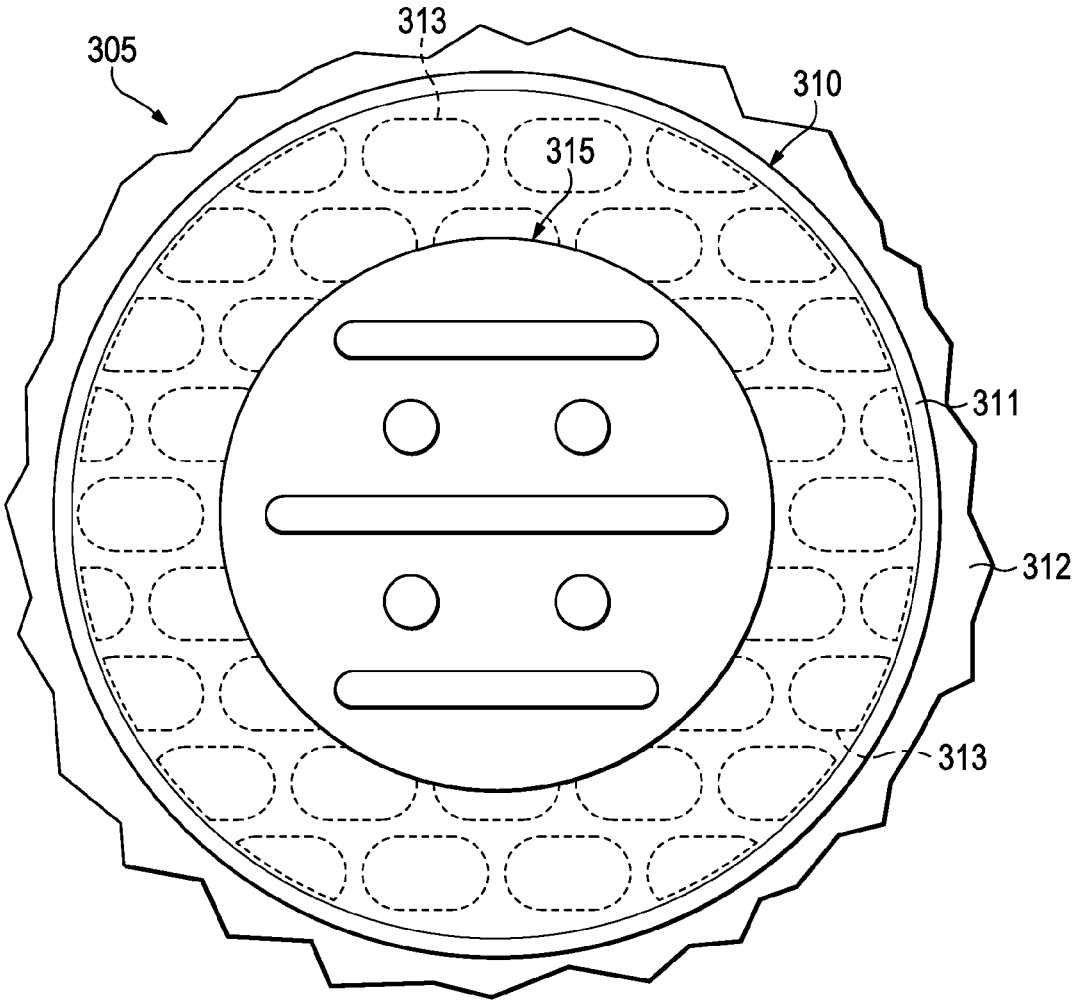
Figure 19E:
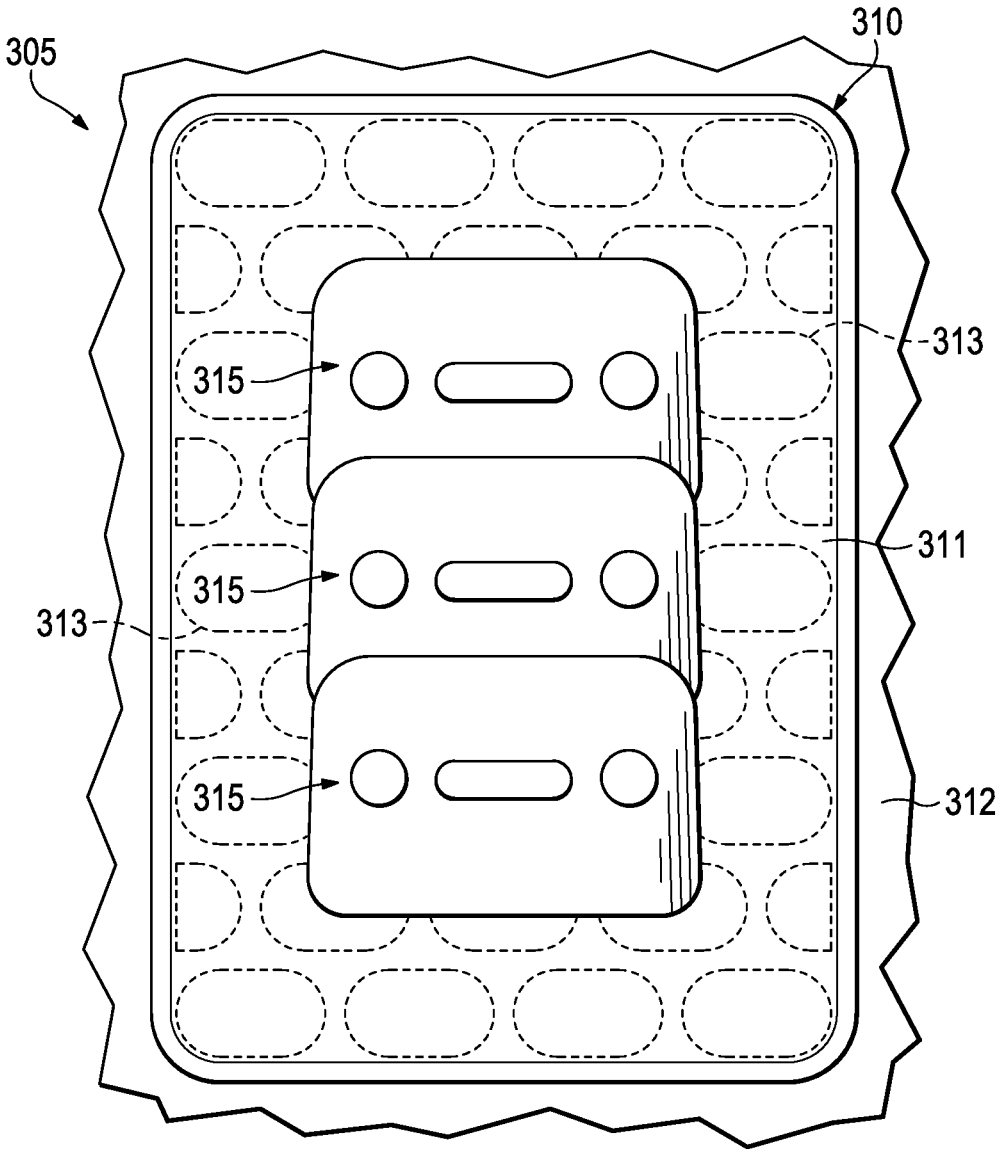

Plate element 315 may cover a majority or even all of cushioning element 310, as depicted in FIG. 19A. In further configurations, two or more plate elements 315 may be utilized, as depicted in FIG. 19B. In addition to changes in the shape of plate element 315, the overall shape of protective components 305 may vary significantly, as depicted by the rectangular and circular shapes in FIGS. 19C and 19D. As noted above with the configuration of FIG. 19A, two or more plate elements 315 may be utilized. Referring to FIG. 19E, a similar configuration wherein three separate plate elements 315 overlap each other is depicted to impart flexibility without gaps or other discontinuities between plate elements 315.

Figure 20A:
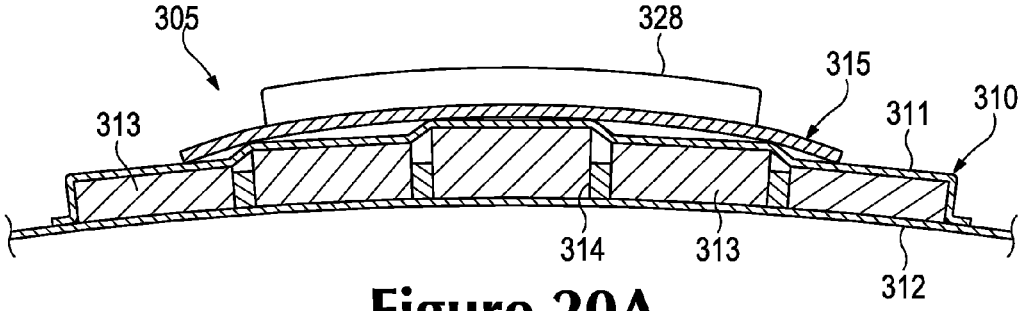
FIGS. 20A-20C are cross-sectional views corresponding with FIG. 16A and depicting further configurations of the protective component.
Figure 20B:
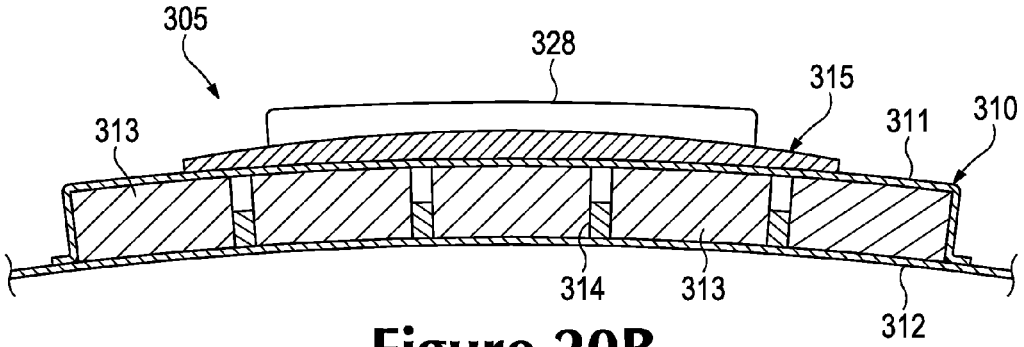
Figure 20C:
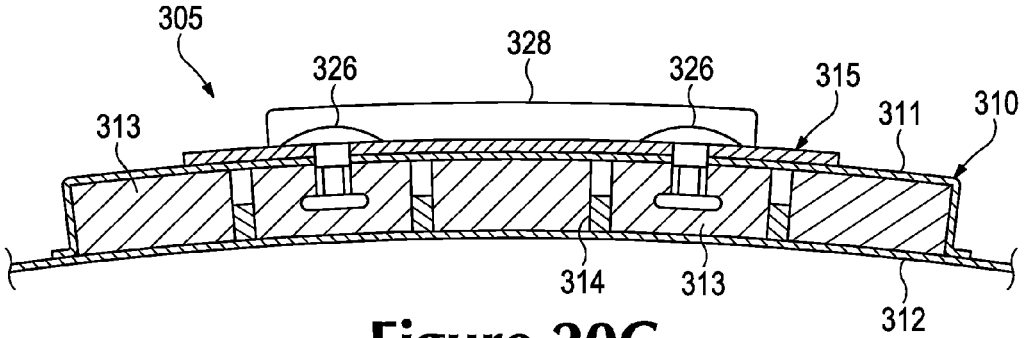

Although the thicknesses of pads 313 may be substantially identical, the thicknesses may also vary, as depicted in FIG. 20A. The thickness of plate element 315 may also vary. As depicted in FIG. 20B, the thickness of plate element 315 tapers across the width of cushioning element 310. In some configurations of cushioning element 310, securing elements 326 may also be anchored within pads 313, rather than extending through pads 313.

Article Of Protective Apparel

Figure 21:
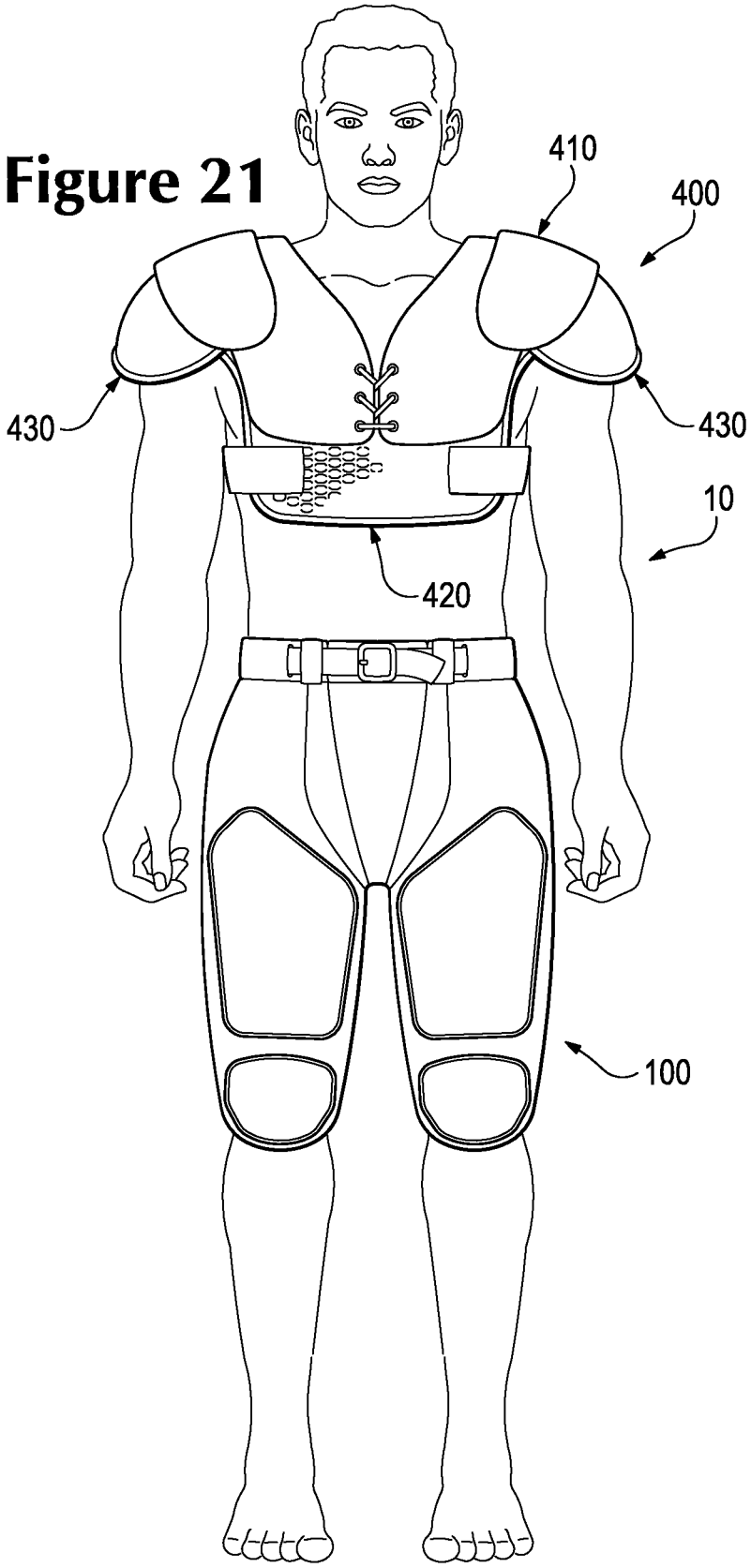
FIG. 21 is a front elevational view of the individual wearing an article of protective apparel having a configuration of shoulder pads and including a plate element and a cushioning element.

With reference to FIG. 21, individual 10 is depicted as wearing an article of protective apparel 400 with the configuration of shoulder pads, which may be utilized in various contact sports, such as American football. Protective apparel 400 includes a plate element 410, a torso cushioning element 420, and a pair of shoulder cushioning elements 430. Plate element 410 covers or extends over an upper torso and shoulders of individual 10. Torso cushioning element 420 is secured to plate element 410 and located between plate element 410 and individual 10. Moreover, torso cushioning element 420 covers or extends over the upper torso and a middle torso of individual 10, thereby extending downward from plate element 410. Shoulder cushioning elements 430, which cover or extend over the shoulders, are also secured to plate element 410 and located between plate element 410 and individual 10. In combination, elements 410, 420, and 430 impart padding, cushioning, or otherwise attenuate impact forces, thereby imparting protection to individual 10.

Figure 22:
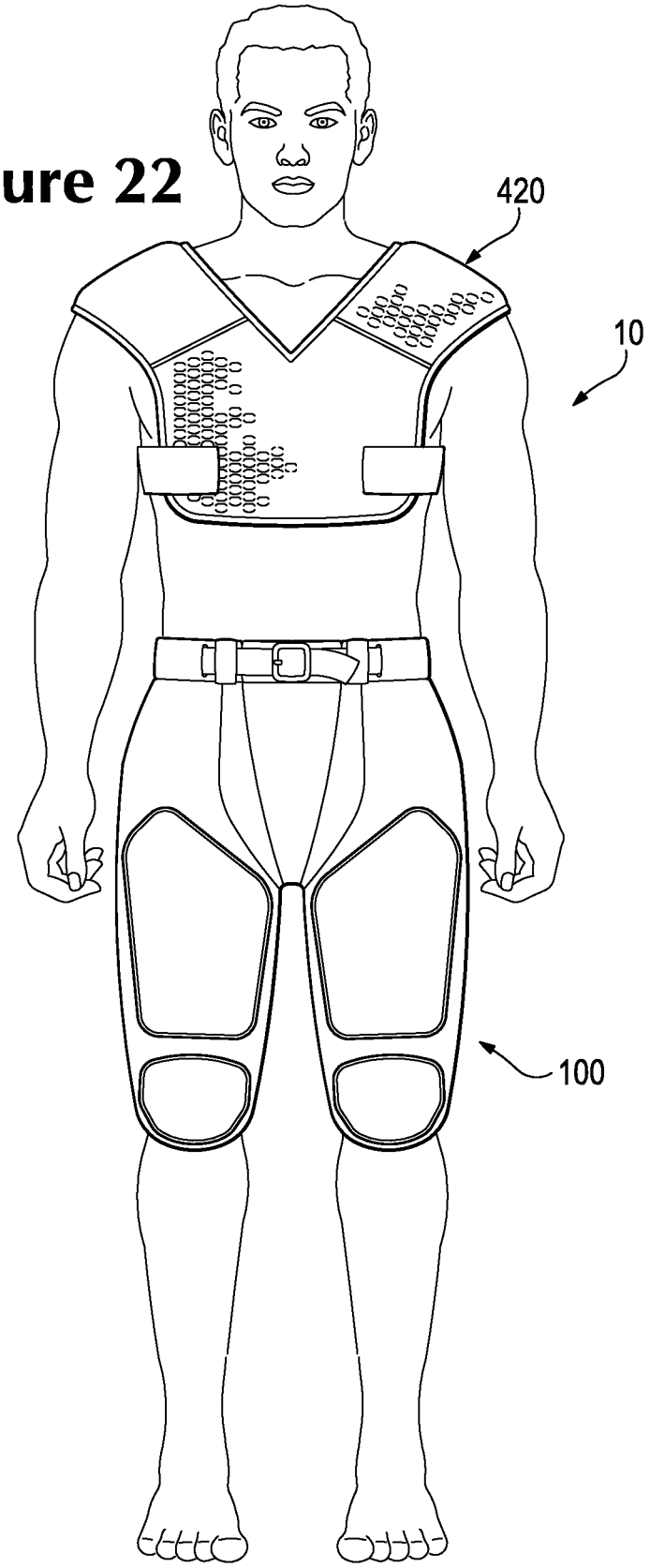
FIG. 22 is a front elevational view of the individual wearing the cushioning element.

In the sport of American football, for example, shoulder pads are worn by athletes during athletic competitions. For some athletic training sessions (e.g., practices), however, separate protective pads that do not include plate-like components are worn in place of the shoulder pads. Accordingly, athletic organizations, schools, teams, or the athletes generally purchase or otherwise obtain both the shoulder pads and the protective pads for each of the athletes. An advantage of protective apparel 400, however, relates to the separability of elements 410 and 420. During the athletic competitions, the combination of plate element 410, torso cushioning element 420, and shoulder cushioning elements 430 may be worn to impart protection to individual 10 from contact with other athletes, equipment, or the ground. During the athletic training sessions, however, torso cushioning element 420 may be separated from plate element 410, and torso cushioning element 420 may be worn alone, as depicted in FIG. 22, to provide a moderate degree of protection to individual 10 from contact with other athletes, equipment, or the ground. That is, torso cushioning element 420 may be worn without plate element 410 during the athletic training sessions. Prior to an athletic competition, elements 410 and 420 may be rejoined for use during the athletic competition. As such, athletic organizations, schools, teams, or the athletes may obtain protective apparel 400 to be properly outfitted during both the athletic competitions and the athletic training sessions.

Figure 23:
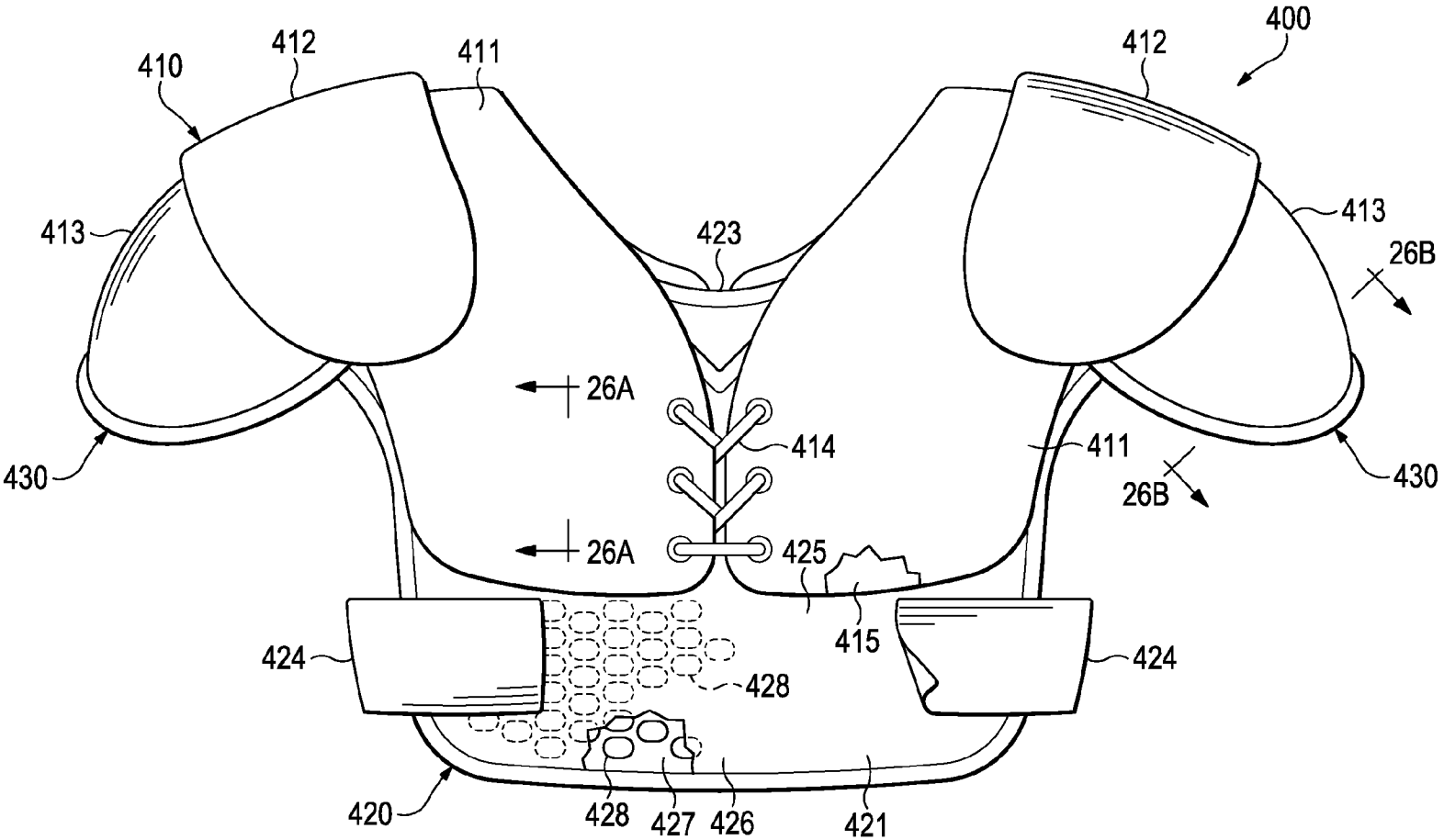
FIG. 23 is a front elevational view of the article of protective apparel.
Figure 24:
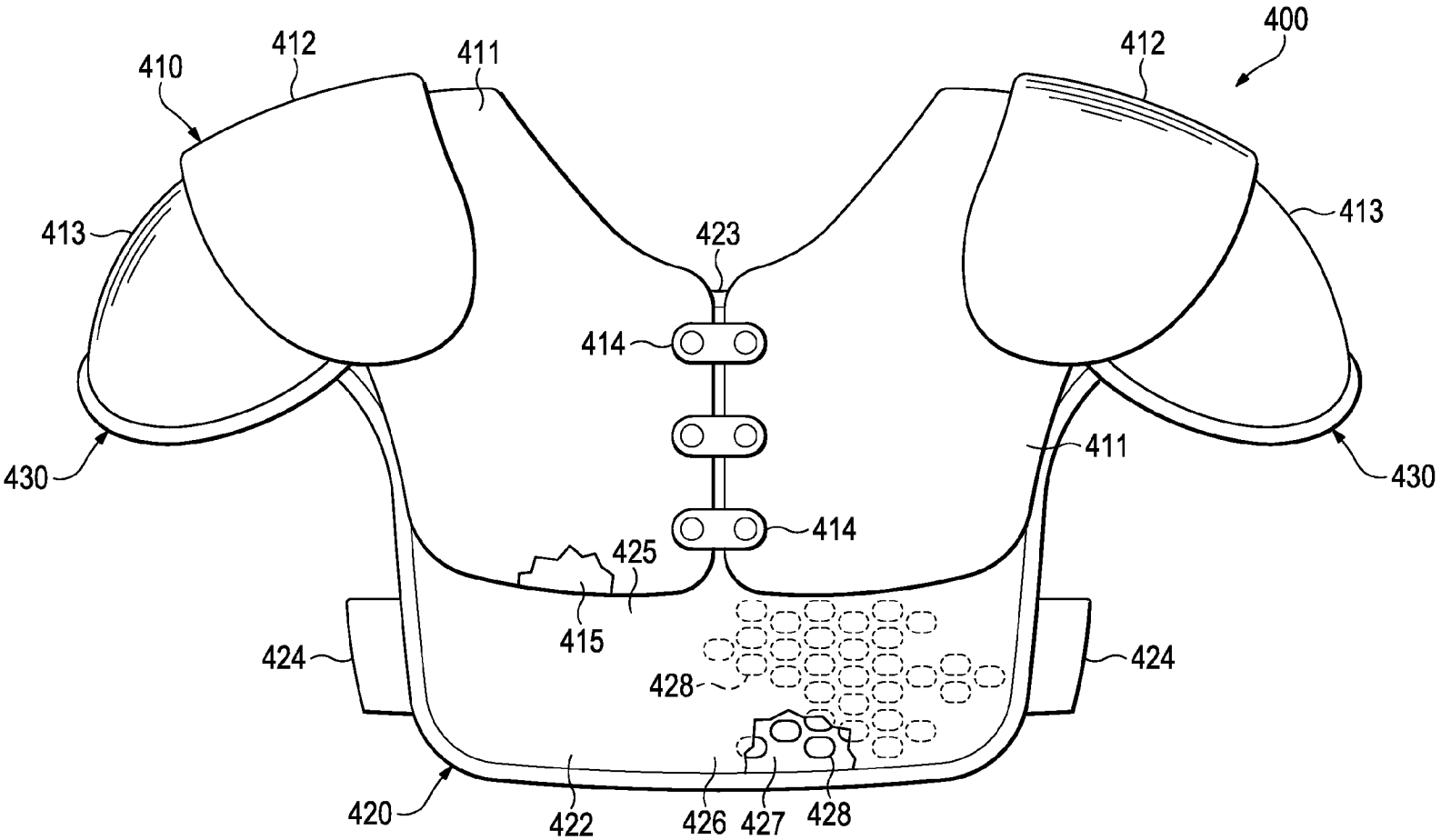
FIG. 24 is a rear elevational view of the article of protective apparel.
Figure 25:
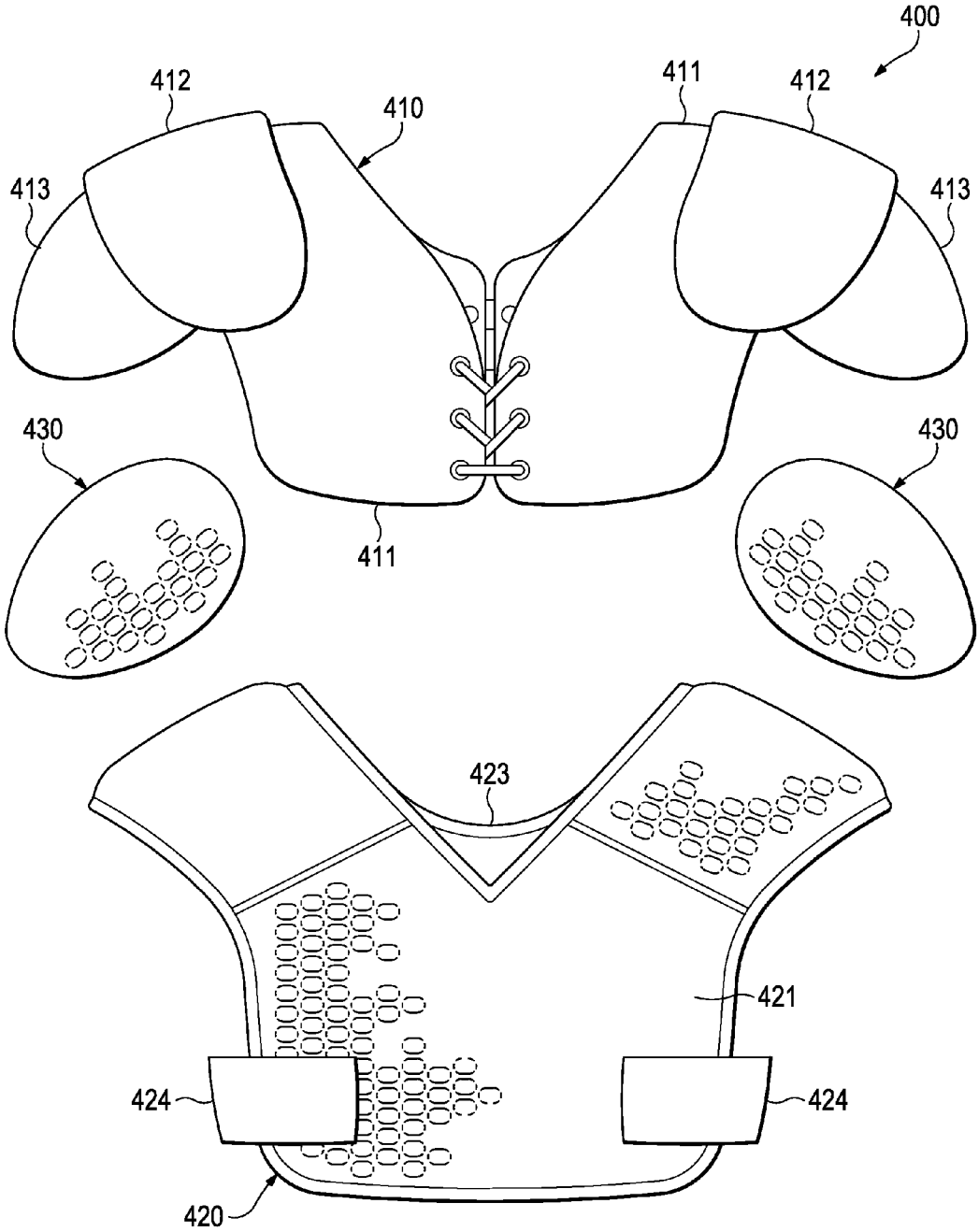
FIG. 25 is an exploded front elevational view of the article of protective apparel.

Protective apparel 400 is depicted individually in FIGS. 23-25. Plate element 410 includes a torso portion 411, two inner shoulder portions 412, and two outer shoulder portions 413. Torso portion 411 covers or otherwise extends over an upper torso of individual 10. More particularly, torso portion 411 extends over both the chest and back of individual 10. Torso portion 411 may be formed from a plurality of plate-like components that are joined by various connectors 414. For example, one of connectors 414 on a front side of plate element 410 has a configuration of a lace that extends repeatedly between two plate-like components, thereby providing some adjustability. Various connectors 414 on a back side of plate element 410 have configurations of straps that extend between two plate-like components.

Shoulder portions 412 and 413 also have the configuration of plate-like components and cover or otherwise extend over the shoulders of individual 10. Inner shoulder portions 412 overlap spaces between torso portion 411 and outer shoulder portions 413. In some configurations, each of shoulder portions 412 and 413 are flexibly-secured to torso portion 411. In other configurations, outer shoulder portions 413 are flexibly-secured to inner shoulder portions 412, and inner shoulder portions 412 are flexibly-secured to torso portion 411. In either configuration, shoulder portions 412 and 413 are secured at opposite sides of torso portion 411.

Plate element 410 is primarily formed from a semi-rigid or rigid polymer material, which may be a non-foamed polymer material. Examples of suitable polymer materials for plate element 410 (i.e., portions 411, 412, and 413) include polyethylene, polypropylene, acrylonitrile butadiene styrene, polyester, thermoset urethane, thermoplastic urethane, polyether block amide, polybutylene terephthalate various nylon formulations, or blends of these materials. Composite materials may also be formed by incorporating glass fibers, aramid fibers, or carbon fibers, for example, into the polymer materials discussed above in order to enhance the strength and rigidity of plate element 410. In some configurations, plate element 410 may also be formed from metal materials (e.g., aluminum, titanium, steel) or may include metal elements that enhance the strength and rigidity of plate element 410. Accordingly, a variety of materials may be utilized for plate element 410.

Figure 27:
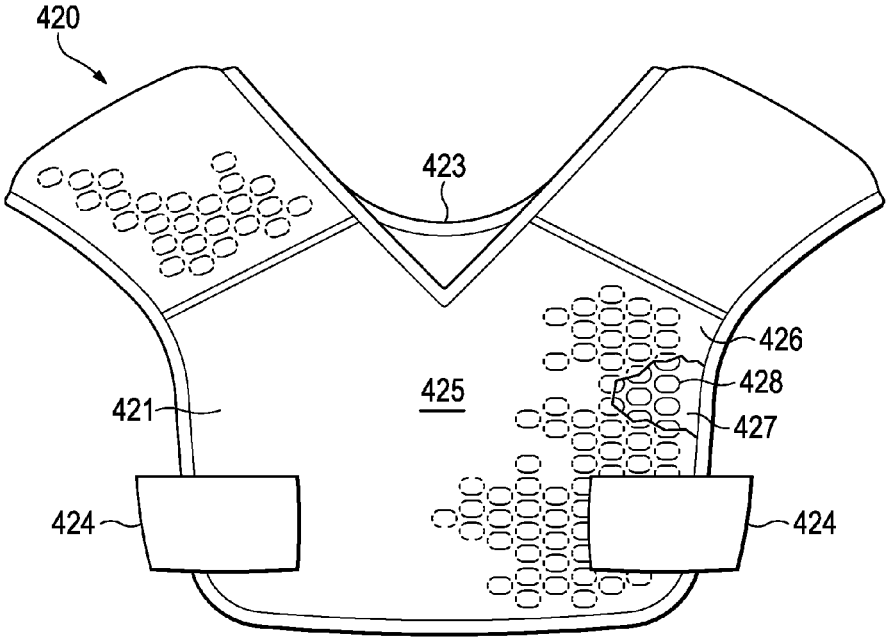
FIG. 27 is a front elevational view of the cushioning element.
Figure 28:
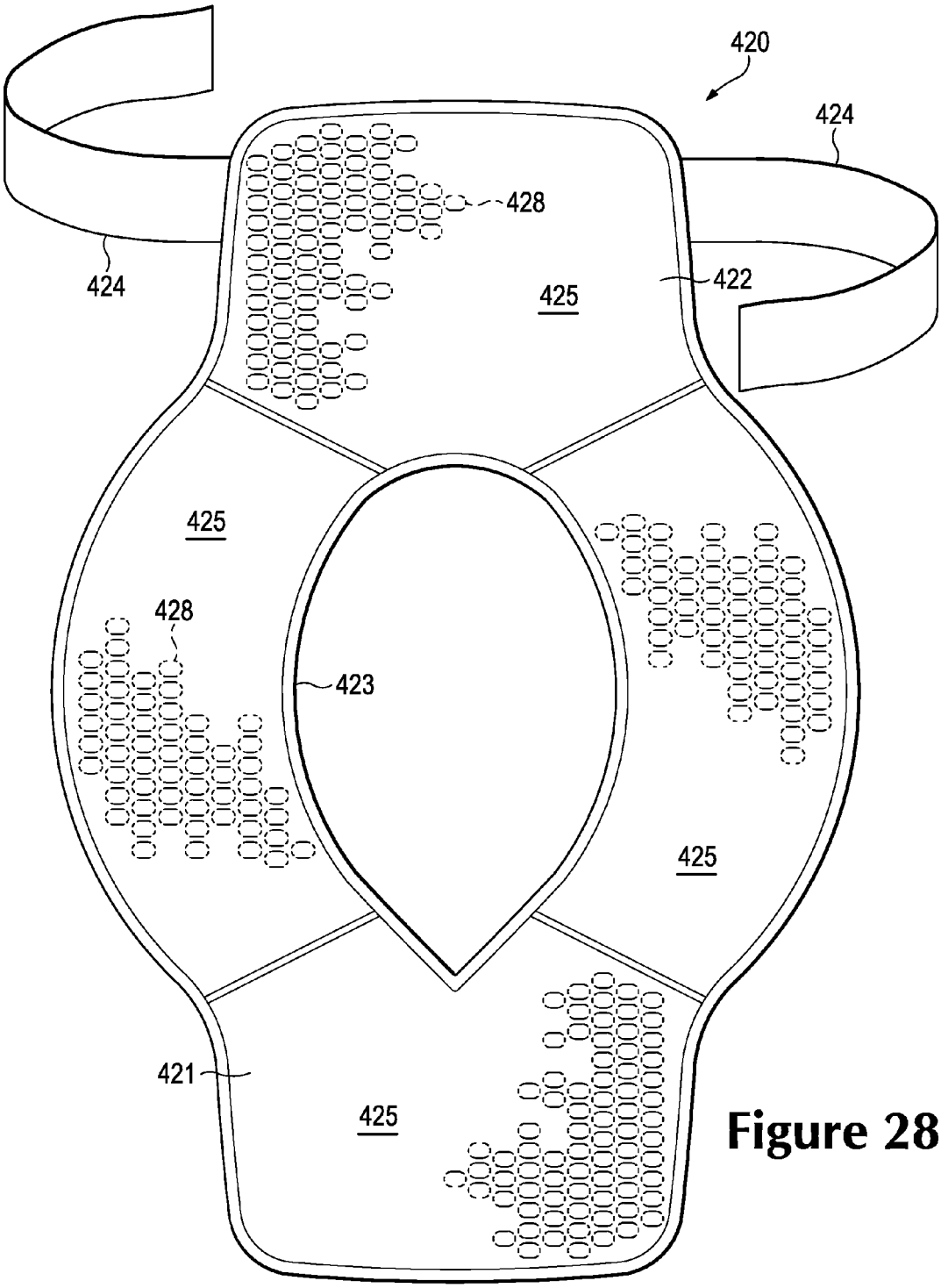
FIG. 28 is a plan view of the cushioning element in a flat configuration.

Torso cushioning element 420 is depicted in combination with plate element 410 in FIGS. 23-25 and is depicted individually in FIGS. 27 and 28. When secured to plate element 410, torso cushioning element 420 is located between plate element 410 and individual 10 to cover or extend over the upper torso and middle torso of individual 10. Although torso cushioning element 420 may have a variety of configurations, torso cushioning element 420 is depicted as including (a) a chest portion 421 that covers or extends over a chest of individual 10, (b) a back portion 422 that covers or extends over a back of individual 10, and (c) a neck aperture 423 located between portions 421 and 422 for receiving or extending around a neck of individual 10. As such, torso cushioning element 420 covers many of the same areas of individual 10 as plate element 410. In order to impart additional protection, however, torso cushioning element 420 extends downward to cover the middle torso. At the middle torso, therefore, torso cushioning element 420 forms the exterior surface of protective apparel 400. In order to secure torso cushioning element 420 to individual 10, two straps 424 extend between lower areas of portions 421 and 422.

Figure 26A:
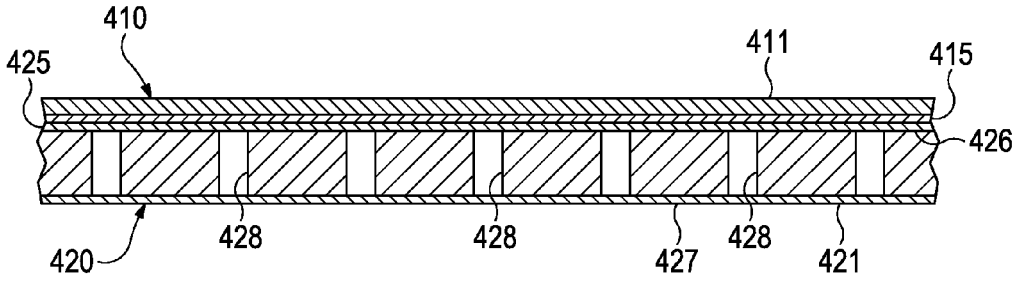
FIGS. 26A and 26B are cross-sectional views of the article of protective apparel, as defined by section lines 26A and 26B in FIG. 23.

The primary elements of torso cushioning element 420 are a first material layer 426, a second material layer 427, and a plurality of compressible pads 428 located between and secured to material layers 426 and 427, as depicted in FIG. 26A. In general, torso cushioning element 420 has the configuration of cushioning element 310. As such, first material layer 426 and second material layer 427 cooperatively form a pocket or void, in which pads 428 are located, and opposite surfaces of pads 428 are secured to material layers 426 and 427. Although pads 428 are spaced evenly from each other and arranged in offset rows, other configurations for pads 428 may be utilized. Moreover, pads 428 are generally discrete elements that are spaced from each other, but may also be connected or formed as a one-piece unit. Given this configuration, torso cushioning element 420 may simultaneously provide one or more of breathability, a relatively low overall mass, and launderability.

A variety of materials may be utilized for pads 428, including any of the various materials discussed above for pad 213, such as polymer foam materials and fluid-filled chambers. As a comparison with the compressible polymer foam material forming pads 428, plate element 410 is discussed above as including a semi-rigid or rigid polymer material. As such plate element 410 may have greater stiffness and density than the polymer foam material of pads 428. As another comparison, whereas pads 428 may be formed from a polymer foam material, plate element 410 may include a non-foamed polymer material.

A hook-and-loop fastening system may be used to join plate element 410 and torso cushioning element 420. More particularly, plate element 410 may include a first part 415 of the hook-and-loop fastening system, and torso cushioning element 420 may incorporate a second part 425 of the hook-and-loop fastening system. Moreover, first part 415 is joinable to second part 425 to secure plate element 410 to torso cushioning element 420. Referring to FIGS. 23, 24, and 26A, first part 415 may be located on an inner surface of torso portion 411. Additionally, second part 425 may be incorporated into or otherwise form first material layer 426 of torso cushioning element 420. As such, first material layer 426 may be second part 425 of the hook-and-loop fastening system.

As discussed above, an advantage of protective apparel 400 relates to the separability of plate element 410 and torso cushioning element 420. The hook-and-loop fastening system readily permits elements 410 and 420 to be separated and rejoined. As such, elements 410 and 420 may be joined for use during athletic competitions, and elements 410 and 420 may be separated so that torso cushioning element 420 may be used alone during athletic training sessions. Accordingly, the hook-and-loop fastening system facilitates the use of protective apparel 400 during various types of athletic activities.

Figure 26B:
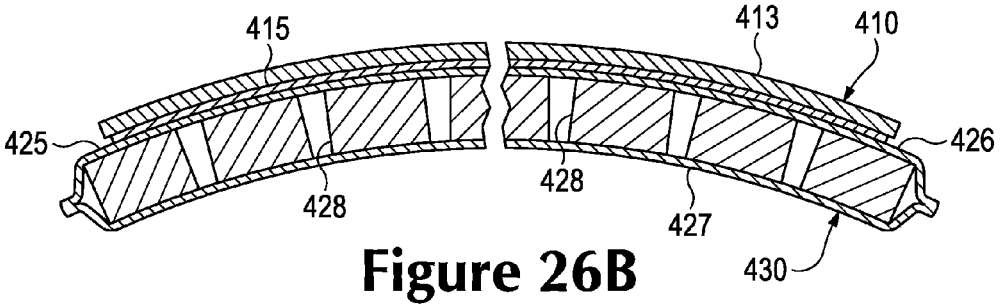

The pair of shoulder cushioning elements 430, which are depicted in FIGS. 25 and 26B, join with outer shoulder portions 413 and cover or otherwise extend over the shoulders of individual 10. As with torso cushioning element 420, shoulder cushioning elements 430 include first material layer 426, second material layer 427, and pads 428, which are located between and secured to material layers 426 and 427. Moreover, first material layer 426 forms second part 425 of the hook-and-loop fastening system, which joins with and separates from first part 415 on an underside of outer shoulder portions 413. In other configurations, additional shoulder cushioning elements 430 may be utilized with inner shoulder portions 410, or shoulder cushioning elements 430 may be lengthened or otherwise enlarged to extend under both of shoulder portions 412 and 413 on each side of protective apparel 400.

Figure 29:
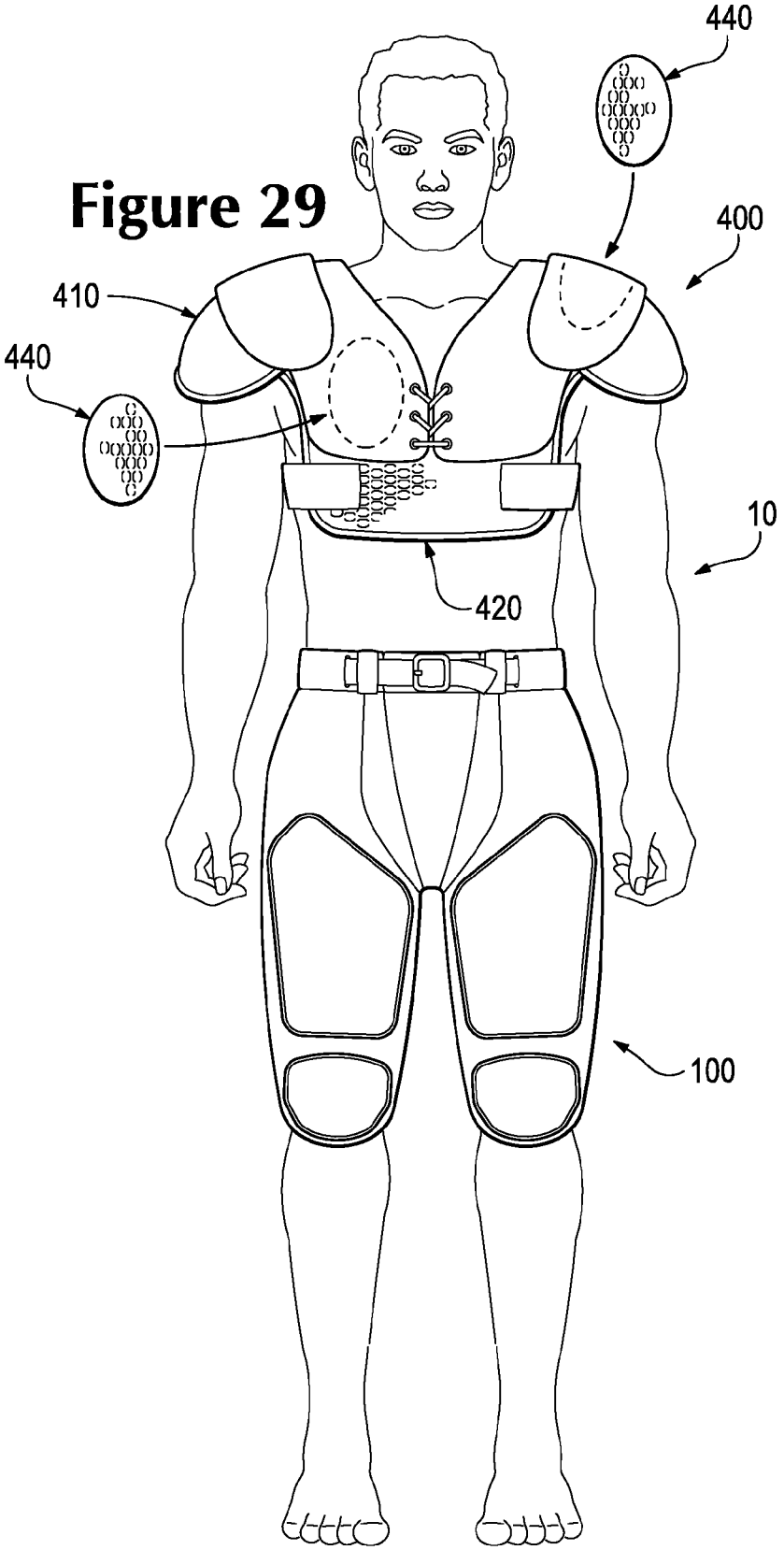
FIG. 29 is a front elevational view of the individual wearing another configuration of the article of protective apparel.

A further advantage to the protective apparel 400 is that individual 10 or another athlete may incorporate various supplemental cushioning elements 440 into areas where additional padding, cushioning, or the distribution or attenuation of impact forces padding is desired. Referring to FIG. 29, two supplemental cushioning elements 440 are depicted and may be located, as an example, under torso portion 411 and under one of inner shoulder portions 412. More particularly, supplemental cushioning elements 440 may be located between elements 410 and 420 in these areas. In some configurations, supplemental cushioning elements 440 may incorporate both parts 415 and 425 of the hook-and-loop fastening system to join with (a) first part 415 of plate element 410 and (b) second part 425 of torso cushioning element 420. As noted, supplemental cushioning elements 440 may be positioned in areas where additional impact force attenuation is desired. As examples, supplemental cushioning elements 440 may be located in areas that are prone to soreness or injury and areas of a prior injury. As such, protective apparel 410 accommodates the use of additional padding in any area, thereby providing individual 10 with the freedom to customize the force attenuation properties of protective apparel 400.

Figure 30:
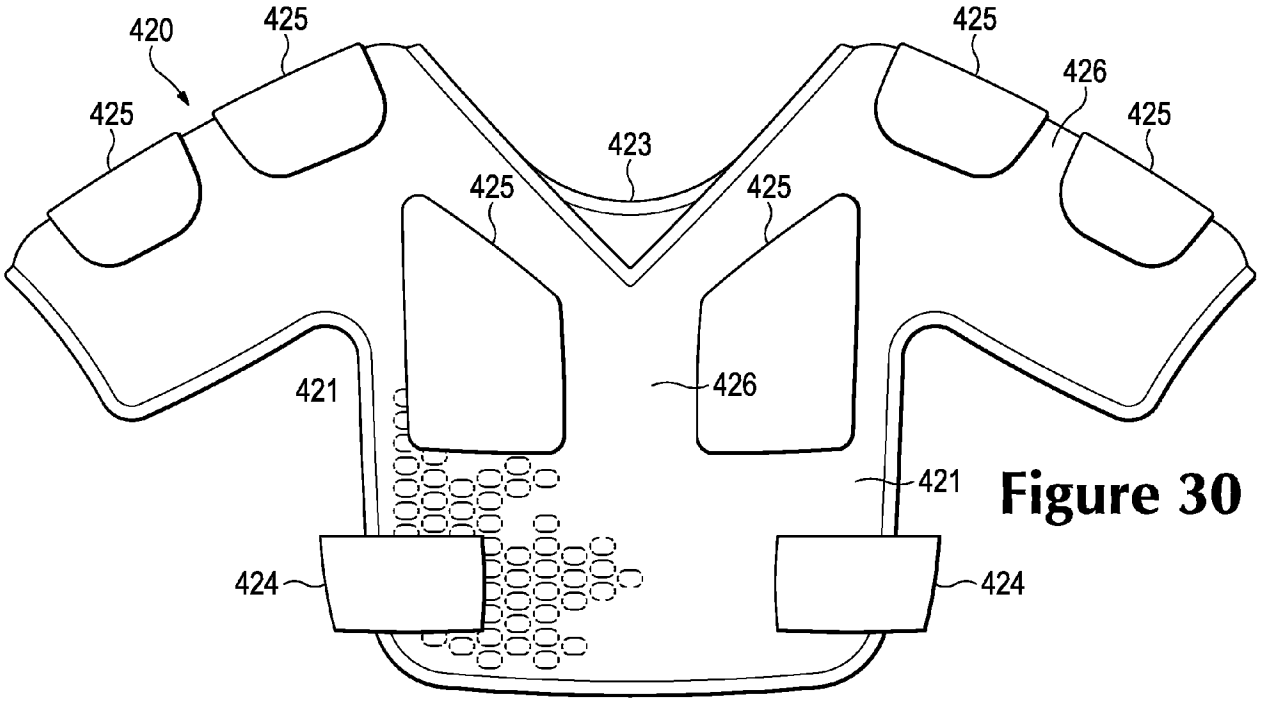
FIG. 30 is a front elevational view of another configuration of the cushioning element.

Torso cushioning element 420 is depicted as primarily covering the upper and middle torso of individual 10. In further configurations, torso cushioning element 420 may extend over other areas of individual 10. As an example, FIG. 30 depicts a configuration wherein torso cushioning element 420 would extend over the shoulders of individual 10, thereby replacing shoulder cushioning elements 430. In some configurations, shoulder cushioning elements 430 may continue to be utilized in order to impart additional cushioning to the shoulders. In other configurations, torso cushioning element 420 may extend downward to cover the lower torso and pelvic region, or torso cushioning element 420 may extend upward to protect the neck. Additional plate-like components may also extend into any of these areas to impart further protection, and the hook-and-loop cushioning system may be utilized to secure the additional plate-like components to torso cushioning element 420.

Figure 31:
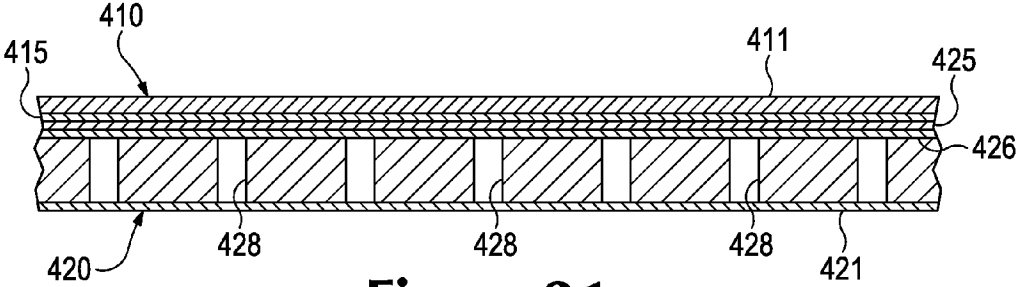
FIG. 31 is a cross-sectional view corresponding with FIG. 26A and depicting the article of protective apparel as incorporating the cushioning element from FIG. 30.

Referring again to FIG. 30, torso cushioning element 420 is depicted as including various separate components that form second part 425 of the hook-and-loop fastening system. As discussed above, first material layer 426 may be second part 425 of the hook-and-loop fastening system. In this configuration, however, the separate components of second part 425 are secured to first material layer 426 (e.g., with stitching, adhesives, thermobonding). As such, the cross-sectional configuration may appear as depicted in FIG. 31, wherein second part 425 is located between first part 415 and first material layer 426 when elements 410 and 420 are joined.

Figure 32:
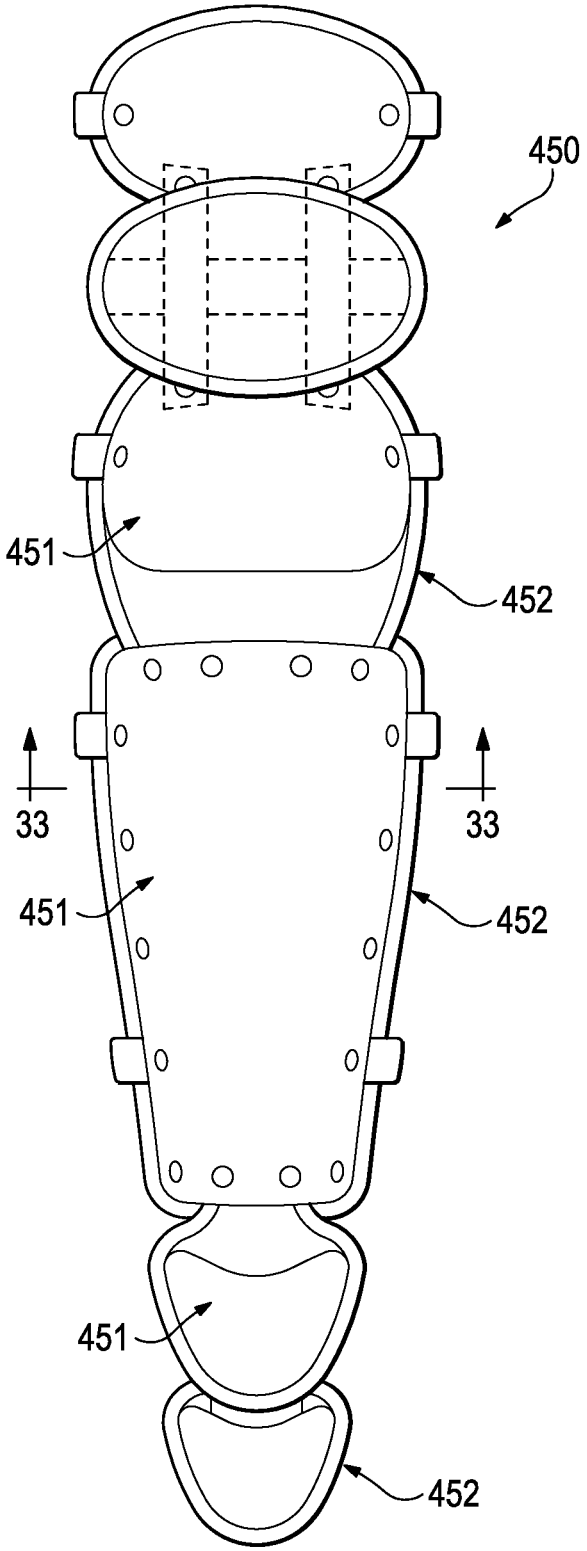
FIG. 32 is a front elevational view of an article of protective apparel having a configuration of a leg guard.
Figure 33:
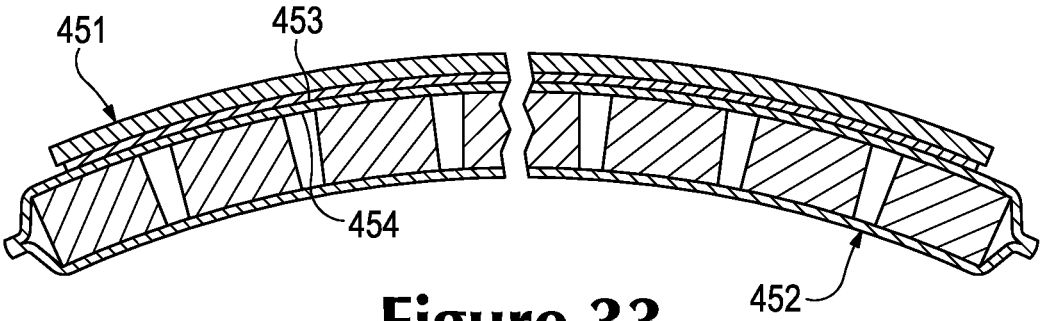
FIG. 33 is a cross-sectional view of the article of protective apparel, as defined by section line 33 in FIG. 32.

Shoulder pads provide one example of the types of protective apparel that may incorporate the features discussed above for protective apparel 400. Other examples that may include plate elements and cushioning elements joined by a hook-and-loop fastening system include (a) further pads utilized for American football, (b) soccer shin guards, (c) helmets for a variety of sports, (d) hockey pads, and (e) protective devices for bicycling, skateboarding, skiing, snowboarding, and various motorsports. As another example, FIG. 32 depicts a baseball catcher's leg guard 450 that includes multiple plate elements 451 and cushioning elements 452. Referring to the cross-section of FIG. 33, parts 453 and 454 of a hook-and-loop fastening system may be utilized to join elements 451 and 452. Although suited for athletic activities, protective apparel having these features may also be utilized in non-athletic pursuits, such as protective apparel for law enforcement, the military, or various other work-related activities. Accordingly, the general structure discussed above for protective apparel 400 may be utilized for various protective apparel configurations.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel comprising:

a plate element including a first part of a hook-and-loop fastening system; and a cushioning element incorporating a second part of the hook-and-loop fastening system, the cushioning element including (a) a first material layer and a second material layer and (b) a plurality of compressible pads located between the first material layer and the second material layer, the first part of the hook-and-loop fastening system being joinable to the second part of the hook-and-loop fastening system to secure the plate element to the cushioning element.

2. The article of apparel recited in claim 1, wherein the second part of the hook-and-loop fastening system is secured to the first material layer.

3. The article of apparel recited in claim 1, wherein the first material layer is the second part of the hook-and-loop fastening system.

4. The article of apparel recited in claim 1, wherein the pads are discrete and spaced from each other.

5. The article of apparel recited in claim 4, wherein opposite surfaces of the pads are secured to the first material layer and the second material layer.

6. The article of apparel recited in claim 1, wherein the first material layer and the second material layer are textiles.

7. The article of apparel recited in claim 1, wherein the pads are formed from a polymer foam material and the plate element includes a non-foamed polymer material.

8. The article of apparel recited in claim 1, wherein the pads include a polymer foam material and the plate element includes a polymer material, the polymer material of the plate element having greater stiffness and density than the polymer foam material of the pads.

9. The article of apparel recited in claim 1, wherein the article of apparel is a pants-type garment.

10. The article of apparel recited in claim 1, wherein the article of apparel is protective apparel for a contact sport.

11. An article of apparel comprising:

a plate element having (a) a torso portion for covering an upper torso of a wearer and (b) at least two shoulder portions for covering shoulders of the wearer, the shoulder portions being secured at opposite sides of the torso portion, and at least the torso portion including a first part of a hook-and-loop fastening system; and a cushioning element for covering at least an upper torso of a wearer, the cushioning element incorporating a second part of the hook-and-loop fastening system, and the cushioning element including (a) a first material layer and a second material layer and (b) a plurality of compressible pads located between and secured to the first material layer and the second material layer, the first part of the hook-and-loop fastening system being joinable to the second part of the hook-and-loop fastening system to secure the plate element to the cushioning element.

12. The article of apparel recited in claim 11, wherein the second part of the hook-and-loop fastening system is secured to the first material layer.

13. The article of apparel recited in claim 11, wherein the first material layer is the second part of the hook-and-loop fastening system.

14. The article of apparel recited in claim 11, wherein the shoulder portions each include a third part of the hook-and-loop fastening system, and two shoulder cushioning elements each include a fourth part of the hook-and-loop fastening system, the third part of the hook-and-loop fastening system being joinable to the fourth part of the hook-and-loop fastening system to secure the shoulder cushioning elements to the shoulder portions.

15. The article of apparel recited in claim 11, further including supplemental cushioning elements with a third part of the hook-and-loop fastening system that is joinable to the first part of the hook-and-loop fastening system to secure the supplemental cushioning elements to the torso portion.

16. The article of apparel recited in claim 11, wherein the cushioning element includes (a) a chest portion for covering a chest of the wearer and (b) a back portion for covering a back of the wearer.

17. The article of apparel recited in claim 16, wherein the cushioning element defines a neck aperture for extending around a neck of the wearer, the neck aperture being located between the chest portion and the back portion.

18. The article of apparel recited in claim 11, wherein the first part of the hook-and-loop fastening system is secured to an inner surface of the torso portion.

19. The article of apparel recited in claim 11, wherein the pads are discrete and spaced from each other.

20. The article of apparel recited in claim 11, wherein the first material layer and the second material layer are textiles.

21. The article of apparel recited in claim 11, wherein the pads are formed from a polymer foam material and the plate element includes a non-foamed polymer material.

22. The article of apparel recited in claim 11, wherein the pads include a polymer foam material and the plate element includes a polymer material, the polymer material of the plate element having greater stiffness and density than the polymer foam material of the pads.

23. An article of apparel comprising:

a torso plate for covering an upper torso of a wearer, the torso plate being substantially formed from a polymer material;

at least two shoulder plates for covering shoulders of the wearer, the shoulder portions being located on opposite sides of the torso plate, and the shoulder plates being formed from the polymer material;

a plurality of cushioning elements, at least one of the cushioning elements including (a) a first material layer and a second material layer and (b) a plurality of polymer foam pads located between and secured to the first material layer and the second material layer; and a hook-and-loop fastening system, parts of the hook-and-loop fastening system being joined to the torso plate, the shoulder plates, and the cushioning elements, the hook-and-loop fastening system securing the cushioning elements to the torso plate and the shoulder plates, wherein the polymer material of the torso plate and the shoulder plates has greater stiffness and density than the polymer foam pads.

24. The article of apparel recited in claim 23, wherein a part of the hook-and-loop fastening system is secured to the first material layer.

25. The article of apparel recited in claim 23, wherein the first material layer is a part of the hook-and-loop fastening system.

26. The article of apparel recited in claim 23, wherein at least one of the cushioning elements includes (a) a chest portion for covering a chest of the wearer and (b) a back portion for covering a back of the wearer.

27. The article of apparel recited in claim 26, wherein the cushioning element defines a neck aperture for extending around a neck of the wearer, the neck aperture being located between the chest portion and the back portion.

28. The article of apparel recited in claim 23, wherein the polymer foam pads are discrete and spaced from each other.

29. The article of apparel recited in claim 23, wherein the first material layer and the second material layer are textiles.

* * * * *